US009738413B2

(12) United States Patent
Humphrey et al.

(10) Patent No.: US 9,738,413 B2
(45) Date of Patent: Aug. 22, 2017

(54) CONVERTIBLE CASE WITH DEPLOYABLE VENTILATION PANELS FOR SHIPPING AND DISPLAYING FOOD PRODUCTS

(71) Applicant: Kraft Foods Group Brands LLC, Chicago, IL (US)

(72) Inventors: Laura G. Humphrey, Chicago, IL (US); Amelia S. Presher, Greenville, SC (US); Christopher W. Dunkle, Buffalo Grove, IL (US); Walter D. Keefe, Jr., Carol Stream, IL (US); Joseph Stallings, Evanston, IL (US)

(73) Assignee: Kraft Foods Group Brands LLC, Chicago, IL (US)

( * ) Notice: Subject to any disclaimer, the term of this patent is extended or adjusted under 35 U.S.C. 154(b) by 0 days.

(21) Appl. No.: 15/118,032

(22) PCT Filed: Feb. 17, 2015

(86) PCT No.: PCT/US2015/016123
§ 371 (c)(1),
(2) Date: Aug. 10, 2016

(87) PCT Pub. No.: WO2015/126813
PCT Pub. Date: Aug. 27, 2015

(65) Prior Publication Data

US 2017/0021961 A1 Jan. 26, 2017

Related U.S. Application Data

(60) Provisional application No. 61/943,067, filed on Feb. 21, 2014.

(51) Int. Cl.
*B65D 5/52* (2006.01)
*B65D 5/54* (2006.01)
(Continued)

(52) U.S. Cl.
CPC ..... *B65D 5/548* (2013.01); *B65D 5/324* (2013.01); *B65D 5/4266* (2013.01); *B65D 5/4295* (2013.01); *B65D 5/5495* (2013.01)

(58) Field of Classification Search
USPC ..... 206/736, 738, 746, 772, 774; 229/200, 229/210, 212, 235
See application file for complete search history.

(56) References Cited

U.S. PATENT DOCUMENTS 3,917,158 A 11/1975 Dorofachuk et al.
5,555,982 A 9/1996 Kuhn et al.
(Continued)

FOREIGN PATENT DOCUMENTS

DE 19602688 7/1997
EP 0 816 237 1/1998
(Continued)

OTHER PUBLICATIONS

International Preliminary Report on Patentability, PCT/US2015/016123, 7 pages (dated Sep. 1, 2016).
(Continued)

*Primary Examiner* — Jacob K Ackun
(74) *Attorney, Agent, or Firm* — Foley & Lardner LLP

(57) ABSTRACT

A convertible case for shipping and displaying packages of a food product includes a body formed from a first blank of a cardboard material and a hood formed from a second blank of a cardboard material. The first blank is foldable into a six-sided rectangular body and filled, using automatic or manual production processes, into a shipping configuration assembly having a front with a partially open region and a removable portion with a glue area, a back having a partially open region and a removable portion having a glue region, a left side, a right side, a top having a left panel and a right panel that are each shaped to provide a logo area and
(Continued)

defining a partially open region between the logo areas, and a bottom having one or more selectively removable vent panels.

20 Claims, 31 Drawing Sheets

(51) Int. Cl.
*B65D 5/32* (2006.01)
*B65D 5/42* (2006.01)

(56) References Cited

U.S. PATENT DOCUMENTS 5,699,957 A 12/1997 Blin et al.
5,921,398 A 7/1999 Carroll
5,927,498 A 7/1999 Saam
D419,440 S 1/2000 Hansen
6,073,833 A * 6/2000 Desrosiers ..... B65D 5/5445 229/164
6,129,211 A 10/2000 Prakken et al.
6,168,027 B1 * 1/2001 Esser ..... B65D 5/48014 206/738
6,523,692 B2 2/2003 Gregory
D503,614 S 4/2005 Sax et al.
7,021,468 B2 4/2006 Cargile, Jr.
7,225,930 B2 6/2007 Ford et al.
7,784,675 B2 8/2010 Sutherland et al.
8,028,839 B2 10/2011 Learn
8,281,981 B2 10/2012 Foden
8,622,280 B2 1/2014 Coltri-Johnson et al.
2005/0092649 A1 5/2005 Ford et al.
2005/0263434 A1 12/2005 Tibbels
2006/0006096 A1 1/2006 Funk
2006/0266815 A1 11/2006 Coltri-Johnson et al.
2007/0074997 A1 4/2007 Ford et al.
2010/0276333 A1 * 11/2010 Couture ..... B65D 5/5445 206/774
2013/0199965 A1 * 8/2013 Tibbels ..... B65D 5/52 206/774

FOREIGN PATENT DOCUMENTS

GB 2 088 830 6/1982
GB 2 408 499 6/2005
WO WO-98/31593 7/1998
WO WO-2010/036184 4/2010

OTHER PUBLICATIONS

International Search Report and Written Opinion, PCT/US2015/016123, dated May 20, 2015, 8 pages.

* cited by examiner

CONVERTIBLE CASE WITH DEPLOYABLE VENTILATION PANELS FOR SHIPPING AND DISPLAYING FOOD PRODUCTS

CROSS-REFERENCE TO RELATED APPLICATIONS

The present application is a National Stage of International Application No. PCT/US2015/016123, filed Feb. 17, 2015, which claims the benefit of and priority to U.S. Provisional Patent Application No. 61/943,067, filed Feb. 21, 2014, which is incorporated herein by reference in its entirety.

BACKGROUND

The present disclosure relates generally to shipping containers for food products formed from a foldable sheet material. The disclosure relates more particularly to shipping containers or cases for food products that are convertible from a shipping configuration to a display configuration for displaying the food products for sale. The disclosure relates still more particularly to shipping cases for food products that have one or more selectively removable or deployable panels to enhance ventilation and cooling of the food products that are stored in the display configuration of the case. The disclosure relates more particularly to a case for food products that is convertible from the shipping configuration to the display configuration with selectively removable vent panels that are formed from a blank of the foldable sheet material, and that may be assembled, filled with a food product and closed for shipping using either automatic or manual production processes.

Paperboard or cardboard containers or cases are used extensively in packaging and shipping a wide variety of products, such as food products. Some types of such cases may be opened and used to hold the shipped food product for display at a store or other facility, such as by opening folded panels or removing a tear-away panel or portion of the case to at least partially expose the food product. However, such known shipping and display cases for food products have a number of disadvantages. For example, such cases are often tightly packed with food products to maximize shipping density, leading to poor ventilation and cooling of perishable food products. Other such cases are sized and shaped in a manner that requires the food products to be packed in an undesirable orientation (e.g. on a side edge, etc.), leading to settling or 'clumping' of the food product in a manner that is not readily recoverable when reconfigured in the display orientation (e.g. particularly for moist food products, such as shredded cheeses, etc.). Such known cases also typically completely enclose the food products to provide protection during shipment, and do not permit adequate ventilation of the food products within the case when the case is converted to the display configuration. Prior efforts to enhance ventilation of shipping cases typically involved providing precut openings that compromised protection of the products during shipping, or cutting part of the case away when converting the case to the display configuration that typically results in product damage or loss due to inadvertent cutting of the food products stored in the case, or leads to inconsistent removal of portions of the case that cause loss of structural integrity of the case needed for proper display of the food products. Current designs rely heavily on perforations to open or execute conversion of the case, often requiring heavy manipulation of the perforations and orientation of the case, thereby requiring additional steps to be taken to open or execute a shelf-ready package. Current designs employ perforation designs (e.g., long perforations) that often do not tear as intended and leave rough edges that detract from the consumer's perception of quality. In some cases, when the perforation do not tear correctly, cases may be cut with a knife, potentially damaging the product, or simply discarded.

Accordingly, there exists a need for shipping cases for food products that are convertible from a shipping configuration to a display configuration for displaying the food products for sale, that have one or more selectively removable or deployable panels to enhance ventilation and cooling of the food products that are displayed in the case, and that are formed from a blank of foldable sheet material that may be assembled, filled with food product, and closed for shipping using either automatic or manual production processes, which overcomes the disadvantages associated with conventional shipping case designs.

SUMMARY

One implementation of the present disclosure is a convertible case for shipping and displaying packages of a food product. The case includes a body formed from a first blank of a cardboard material and a cover or hood formed from a second blank of a cardboard material. The first blank is foldable into a six-sided rectangular parallelepiped for the body and filled, using automatic or manual production processes, into a shipping configuration assembly having a front with a partially open region and a removable portion with a glue area, a back having a partially open region and a removable portion having a glue region, a left side, a right side, a top having a left panel and a right panel that are each shaped to provide a logo area and defining a partially open region between the logo areas, and a bottom having one or more selectively removable vent portions. The partially open regions and the removable portions with the glue area are strategically provided, such that upon conversion of the case to a display configuration, the resulting display portions have front and side walls with reduced height that enhance visibility and ventilation among the displayed food products. The selectively removable vent portions permit further reduction of the cardboard material on the back wall to provide supplemental or enhanced ventilation of the food products.

The second blank is foldable about two parallel hinge lines to form an inverted U-shaped hood having a front panel with a push-in tab, a top panel and a back panel having a push-in tab. The hood is sized and shaped to fit over the body so that the front panel attaches to the glue area of the removable portion on the front of the body and covers the front partially open region, and the top panel covers and protects the top logo panels and also covers the top partially open region of the top of the body, and the back panel attaches to the glue area of the removable portion on the back of the body and covers the back partially open region, so that attachment of the hood to the body provides an enclosed case in the shipping configuration.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

BRIEF DESCRIPTION OF THE DRAWINGS

[BRIDGE]

[GAP]

[TAB]

DETAILED DESCRIPTION

Figure 1:
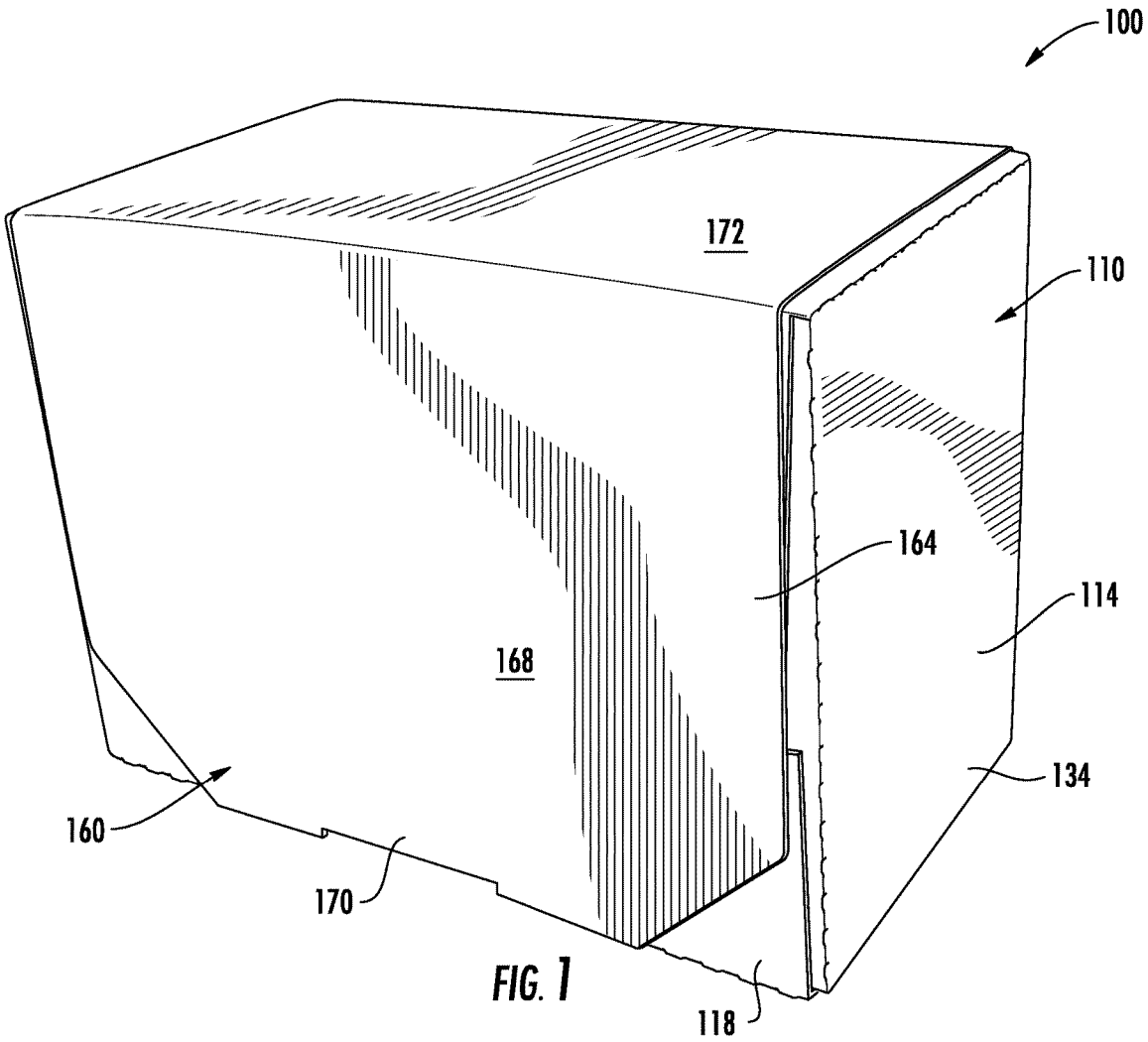
FIG. 1 is a pictorial image of a perspective view of a convertible case for shipping and displaying food products with the hood attached to the body in the shipping configuration, according to an exemplary embodiment.

Before discussing the details of the convertible case with deployable ventilation panels for shipping and displaying food products and/or the components thereof, it should be noted that references to "front," "back," "rear," "side," "upper," "lower," "inner," "outer," "right," and "left" or the like in this description are merely used to identify the various elements as they are oriented in the FIGURES. These terms are not meant to limit the element which they describe, as the various elements may be oriented differently in various applications.

It should further be noted that for purposes of this disclosure, the terms "coupled" or "attached" mean the joining of two members (e.g., surfaces, edges, panels, etc.) directly or indirectly to one another. Such joining may be stationary in nature or moveable in nature. Such joining may be achieved with the two members or the two members and any additional intermediate members. Such joining may be permanent in nature (e.g., fixedly attached, secured, bonded, etc.) or temporary in nature (e.g., releasably attached, engaged, etc.).

Referring generally to the FIGURES, convertible cases with deployable ventilation panels for shipping and displaying food products and components thereof are shown according to various exemplary embodiments. In some implementations, the cases may be used for packaging food products such as multiple packages of a shredded cheese or other food product. The cases may be made of any type of foldable sheet material (e.g., paperboard, paper, cardboard, sheet metal, foldable plastics, etc.). In some embodiments, the cases may be constructed from a die-cut corrugated cardboard blank. All such variations are intended to be included within the scope of this disclosure.

[BRIDGE] Referring now more particularly to FIGS. 1-12, a convertible case 100 for shipping and displaying packages of a food product is shown according to one exemplary embodiment. The case includes a body 110 formed from a first blank 114 of a cardboard material and a cover or hood 160 formed from a second blank 164 of a cardboard material. The first blank 114 is foldable into a six-sided rectangular parallelepiped for the body 110 and folded, assembled and filled, using automatic or manual production processes, into a shipping configuration assembly having a front 118 with a partially open region 120 and a removable portion 122 with a glue area, a back 124 having a partially open region 126 and a removable portion 128 having a glue area, a left side 130, a right side 134, a top 138 having a left panel 140 and a right panel 142 that are each shaped to provide a logo area and defining a partially open region 144 between the logo areas, and a bottom 148 having a removable bridge panel 150 defined by two parallel perforated lines 152, and a first removable vent panel 154 adjacent to a left side of the bridge 150, and a second removable vent panel 156 adjacent to a right side of the bridge 150. Each of the vent panels is defined by perforated lines in the general shape of a rectangle. Upon subsequent removal of the vent panel, the remaining sides of the bottom 148 provide product support surfaces. Each of the vent panels is also shown to include push-in tabs 158 intended to facilitate identification and easy removal of the vent panels by stock personnel at a store or other sales facility during subsequent conversion of the case from the shipping configuration to the display configuration.

Figure 3:
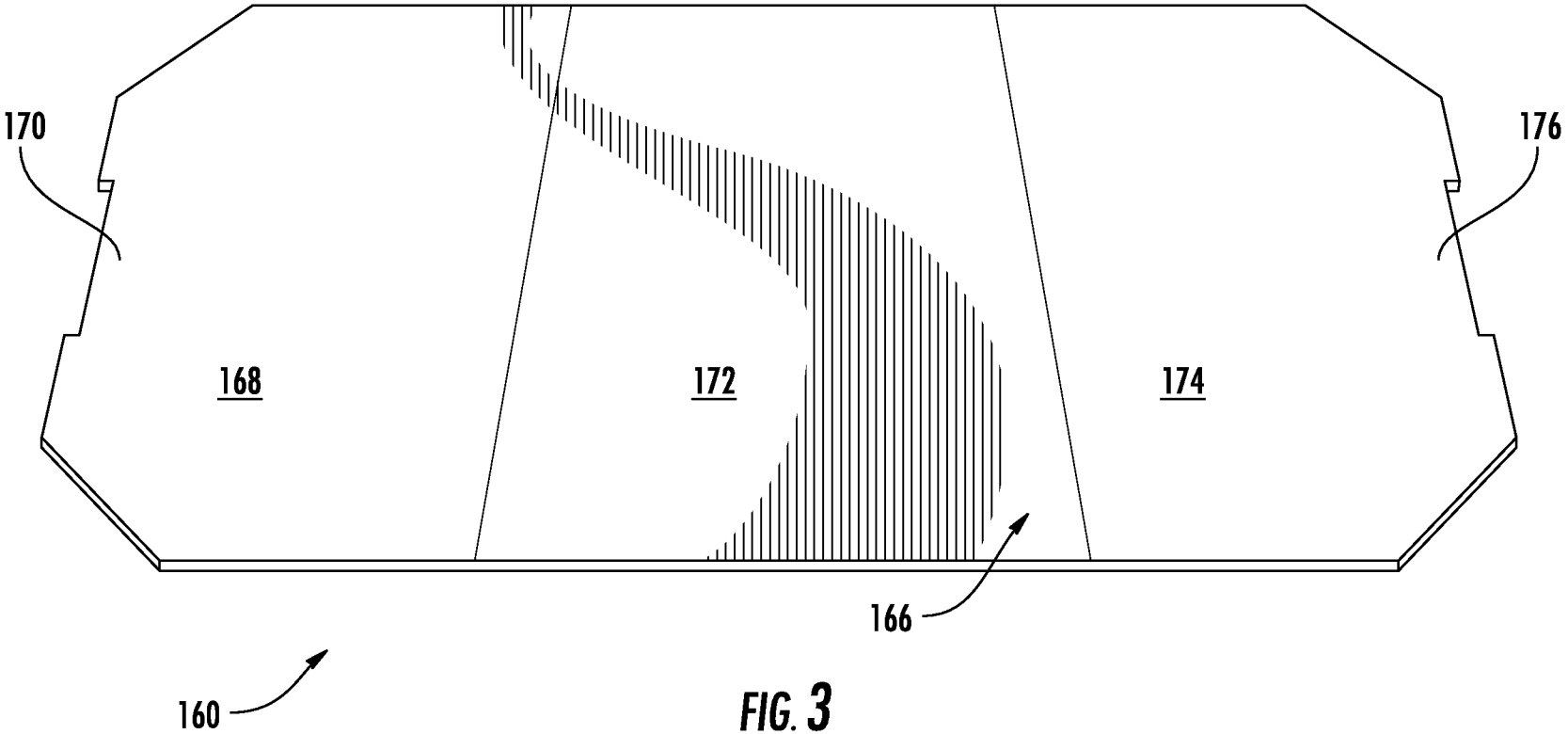
FIG. 3 is a pictorial image of a perspective view of the hood prior to attachment to the body, according to the exemplary embodiment of FIG. 1.
Figure 3A:
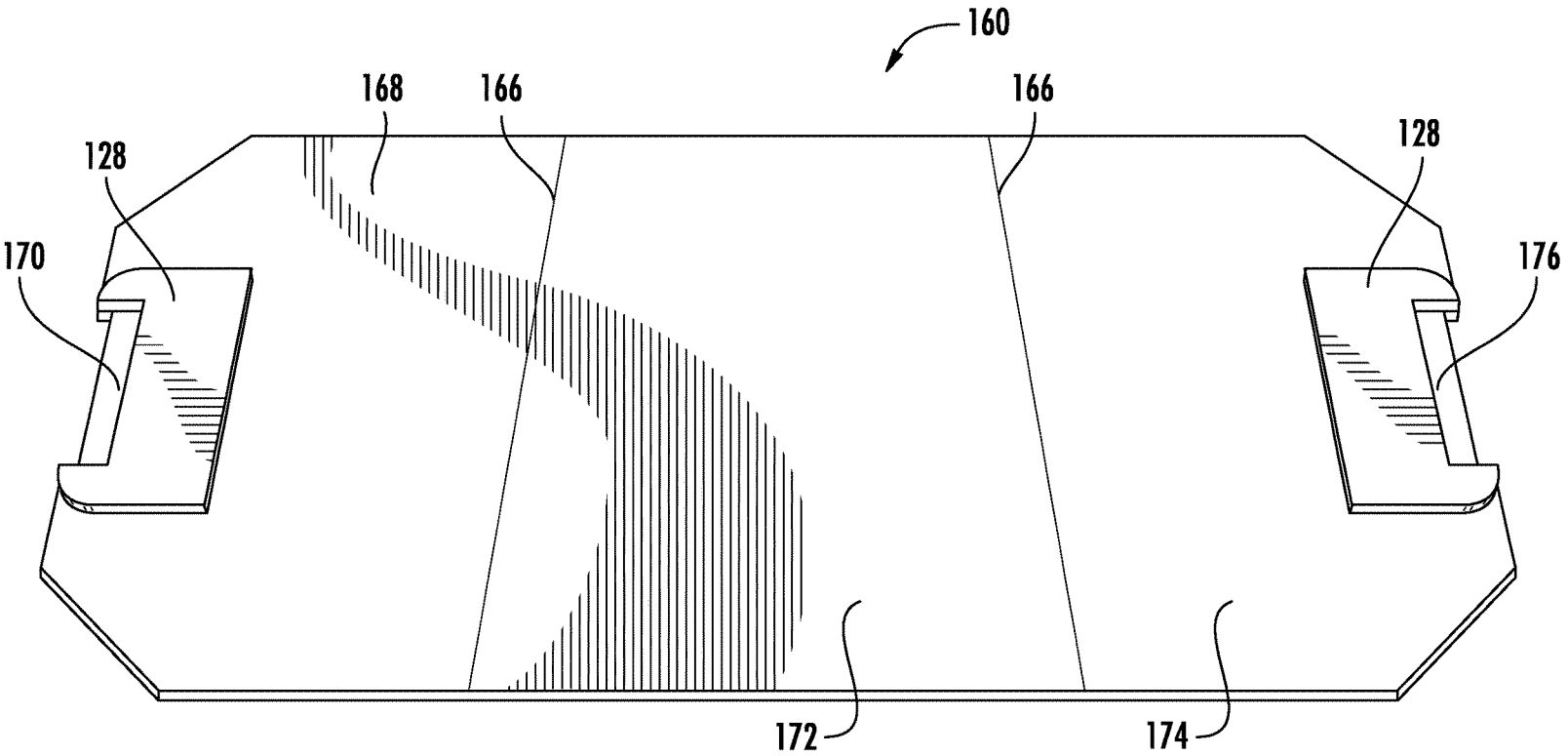
FIG. 3A is a pictorial image of a perspective view of the hood following detachment from the body, according to the exemplary embodiment of FIG. 1.

Referring to FIGS. 3 and 3A, the second blank 160 is foldable about two parallel hinge lines 166 to form an inverted U-shaped hood having a front panel 168 with a push-in tab 170, a top panel 172 and a back panel 174 having a push-in tab 176. The hood 160 is sized and shaped to fit over the body 110 so that front panel 168 attaches to the glue area of the removable portion 122 on the front 118 of the body 110 and covers the front partially open region 120, and the top panel 172 covers the top partially open region 144 of the top 138 of the body 110, and the back panel 174 attaches to the glue area of the removable portion 128 on the back 124 of the body 110 and covers the back partially open region 126, so that attachment of the hood 160 to the body 110 provides an enclosed case in the shipping configuration for protective shipment of the food products to a store or other facility for individual sale of the food products (e.g. wholesale, retail, etc.).

According to one embodiment, the food products may be packages of shredded cheese that are filled into the body 110 in a horizontally flat (i.e. lying on their back side based upon the bottom of the case), and arranged one atop the other in a back-and-forth (or head-to-toe) pattern (see e.g. FIG. 2A), to enhance shipping density within the case 100 in a manner that avoids the packages lying on their lateral sides, to substantially reduce the likelihood of settling and clumping of the shredded cheese during shipment. Packaging in this manner is intended to maximize the density of the food product shipped within the case (and minimize the shipping of 'air'), but also provide advantageous ventilation of the food product packages when arranged in the display portions. The case according to the present embodiment thus maximizes the density of food products shipped within the case, orients the food products in a manner that preserves the integrity of the food products during shipping, and provides for proper ventilation of the food products during display to maintain the integrity and shelf-life of the food products.

Upon arrival of the case 100 at the store, the case may be converted (e.g. by stock personnel, etc.) from the shipping configuration to the display configuration, such that a single case is converted into two separate display portions 102, 104, each display portion holding and displaying approximately one half of the food product packages that were shipped in the case, and configured for placement on a shelf of a refrigerated cooler (or other suitable device).

Figure 2:
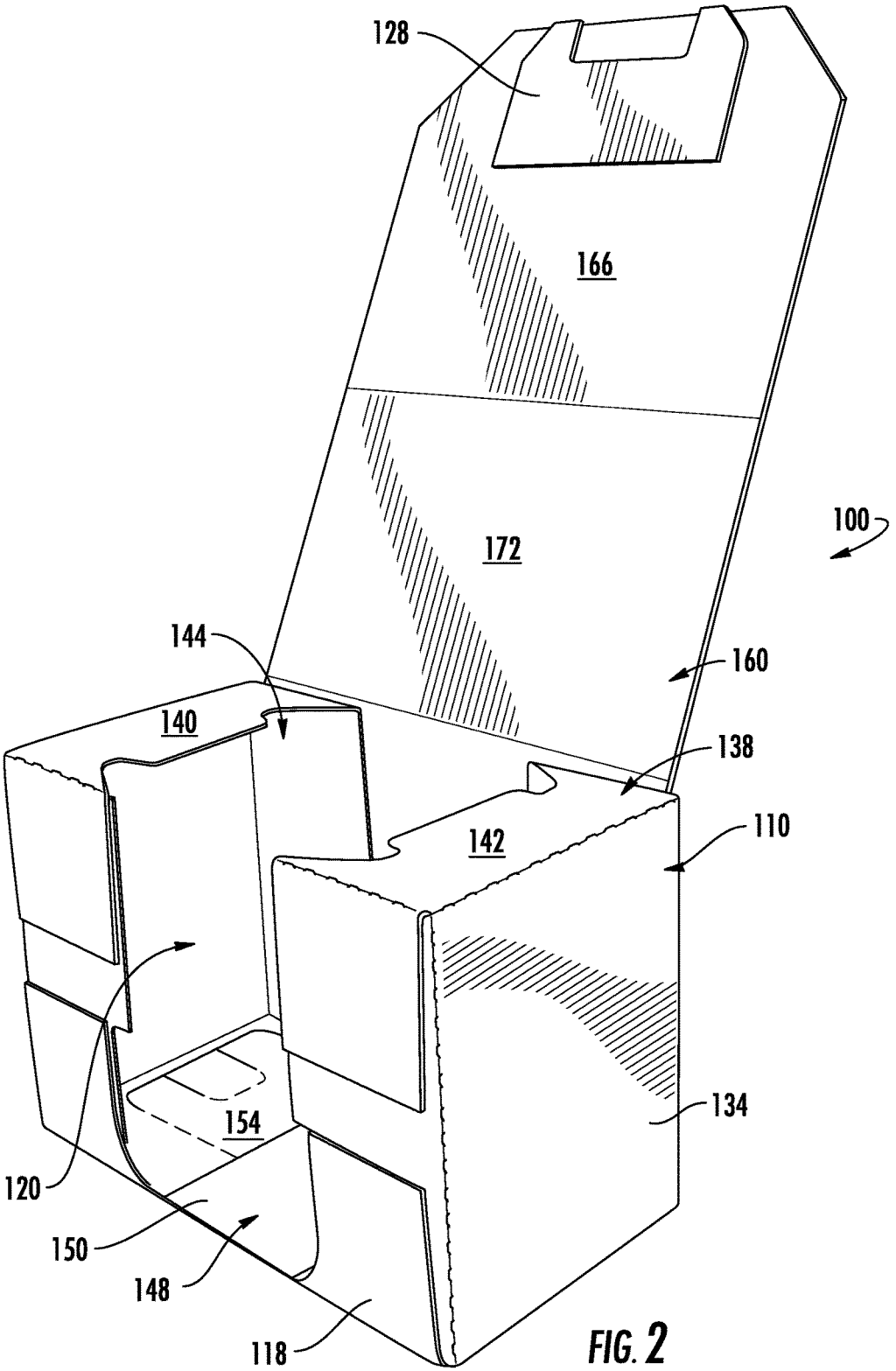
FIG. 2 is a pictorial image of a perspective view of a convertible case for shipping and displaying food products with the front panel and the top panel of the hood detached from the body, according to the exemplary embodiment of FIG. 1.
Figure 2A:
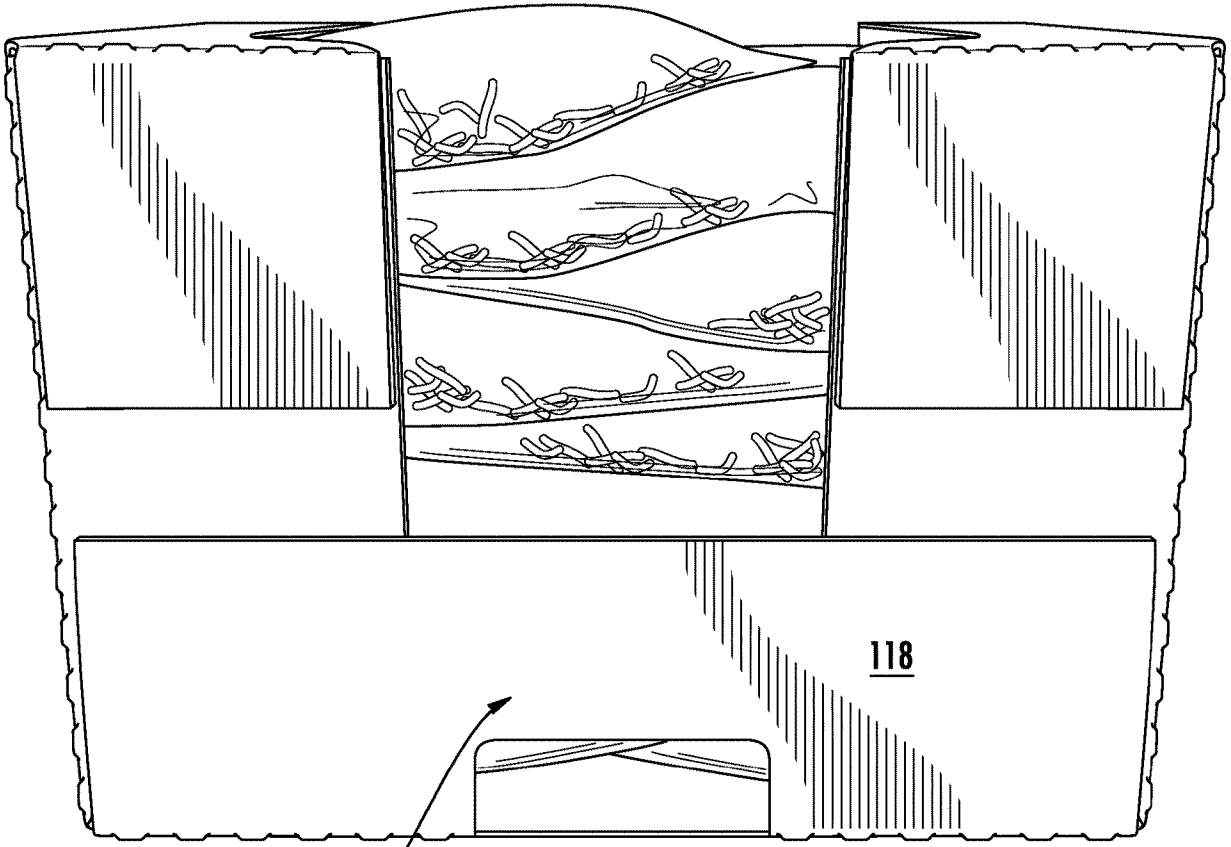
FIG. 2A is a pictorial image of a front view of a convertible case for shipping and displaying food products filled with packages of a food product (shown as a shredded cheese product) arranged in a horizontally flat and alternating manner within the body and before attachment of the hood, according to the exemplary embodiment of FIG. 1.

Referring to FIGS. 2 and 3A, the hood 160 may be detached from the body 110 by depressing the punch-in tabs 170, 176 on the front side 168 and the back side 174 of the hood 160, then pulling the hood 160 free from the body 110. As the hood 160 detaches from the body 110, the removable portions 122, 128 of the front and back of the body 110 that are adhered to the hood 160 at the glue areas separate from the front 118 and back 124 and are removed with the hood 160 (see FIG. 3A).

Figure 4:
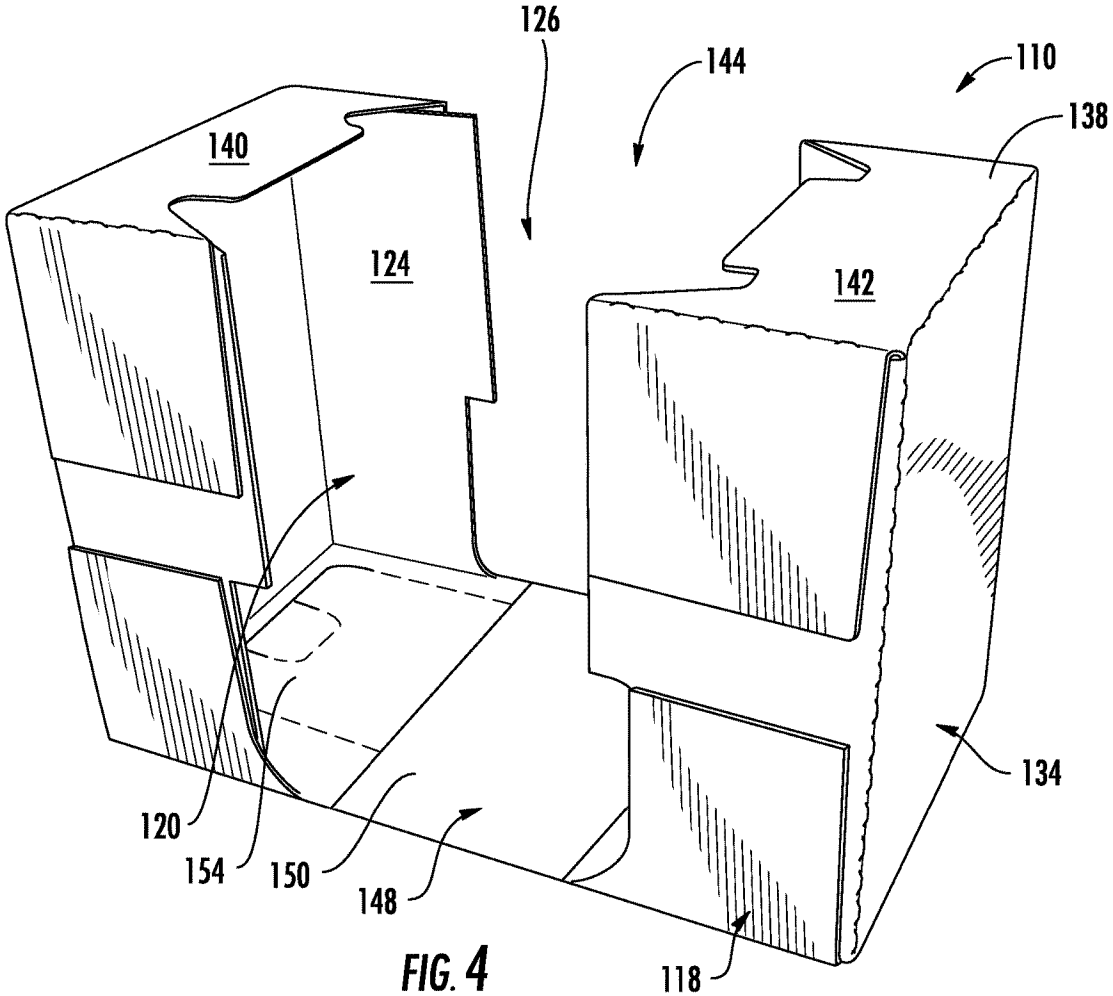
FIG. 4 is a pictorial image of a perspective view of the body of the convertible case for shipping and displaying food products with the hood removed, according to the exemplary embodiment of FIG. 1.
Figure 5:
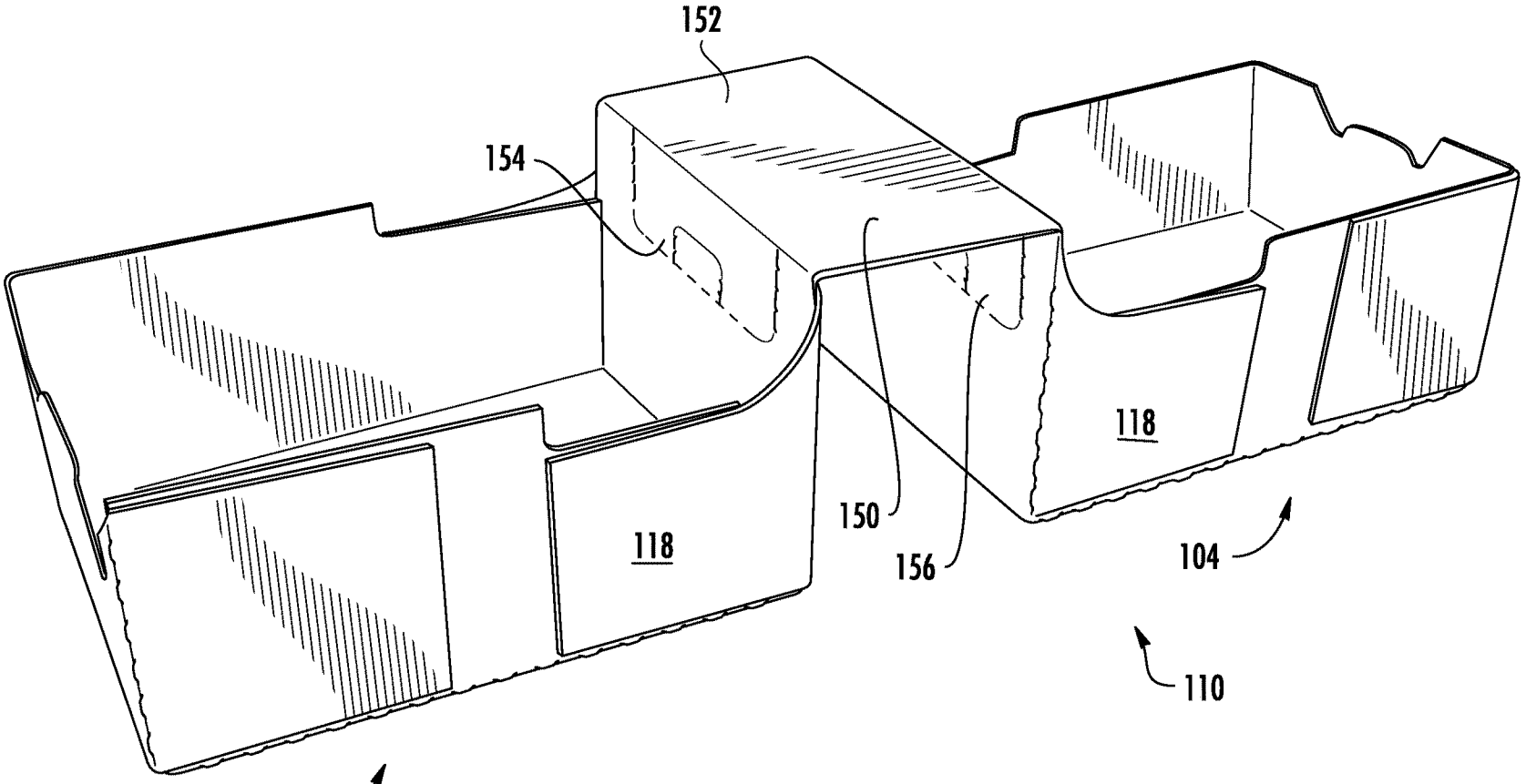
FIG. 5 is a pictorial image of a perspective view of the body of the convertible case for shipping and displaying food products, cracked open into a first display portion and a second display portion that are interconnected by a removable bridge panel on the bottom of the body, according to the exemplary embodiment of FIG. 1.
Figure 6:
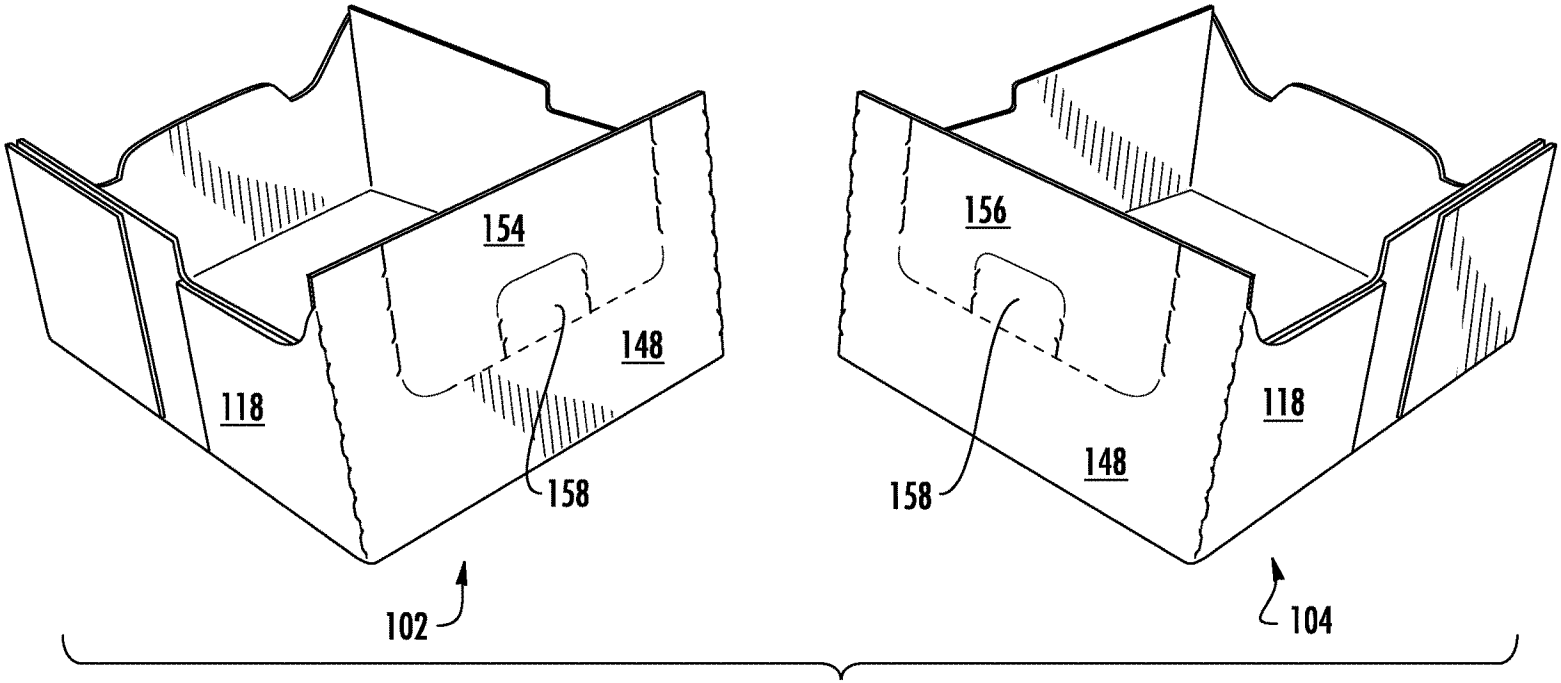
FIG. 6 is a pictorial image of a perspective view of a back side of the first display portion and the second display portion with the bridge panel removed, according to the exemplary embodiment of FIG. 1.

Referring to FIGS. 4-6, each side of the body 110 may be tilted outwardly (e.g. "cracked open" etc.) about the bridge panel 150 on the bottom 148 of the body 110, such that the left 130 and right 134 sides of the body 110 become the bottoms of the first 102 and second 104 display portions, and the remaining portions of the bottom 148 of the body 110 become the backs of the first and second display portions 102, 104, and the first and second logo areas on the top 138 of the body 110 become the fronts of the first and second display portions 102, 104, respectively. With the case 100 cracked open to its display orientation with the first and second display portions 102, 104, the bridge panel 150 may be removed along its two parallel lines of perforation 152 to separate the two display portions 102, 104.

Figure 7:
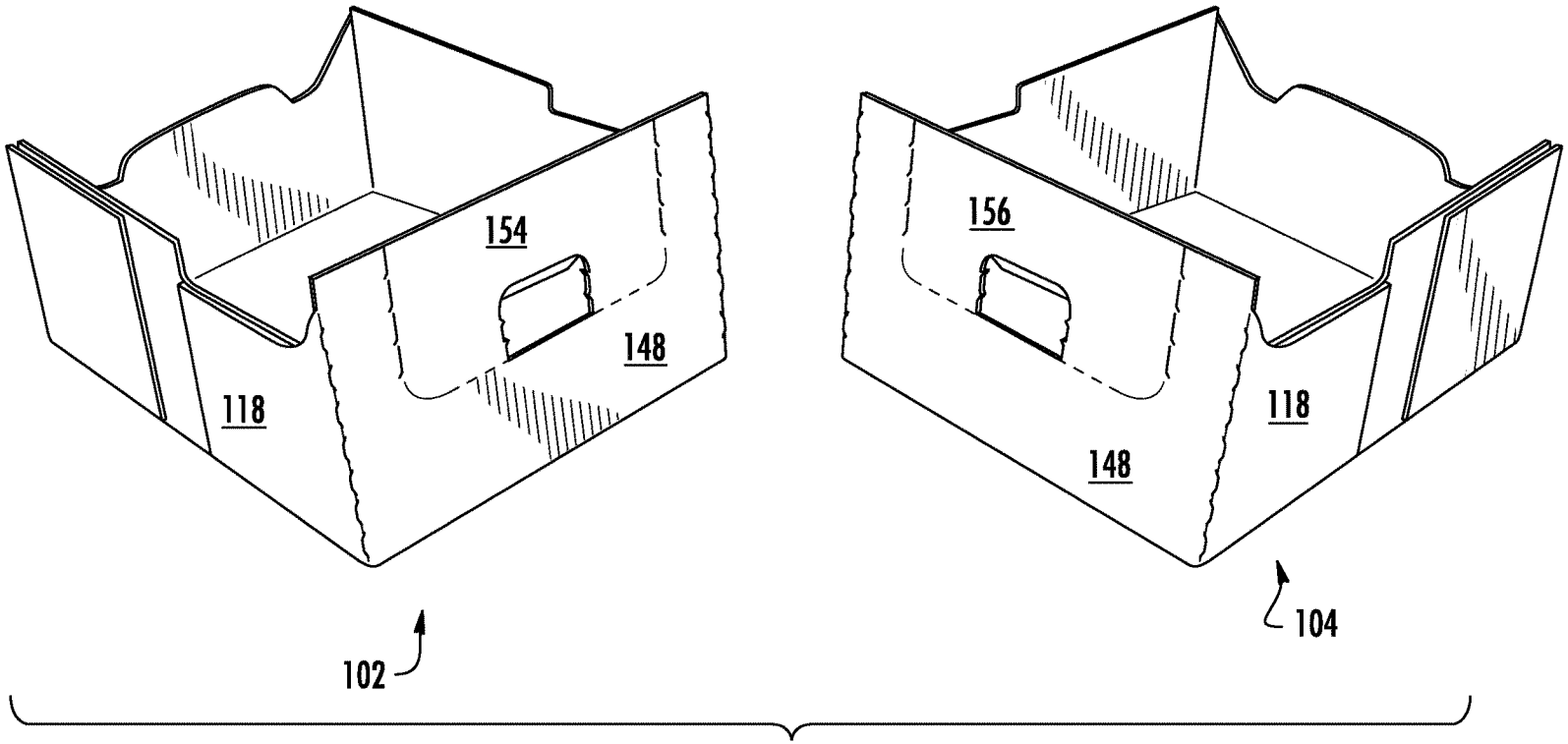
FIG. 7 is a pictorial image of a perspective view of the back side of the first display portion and the second display portion with a push-in tab deployed on a vent panel in each of the first display portion and the second display portion, according to the exemplary embodiment of FIG. 1.
Figure 8:
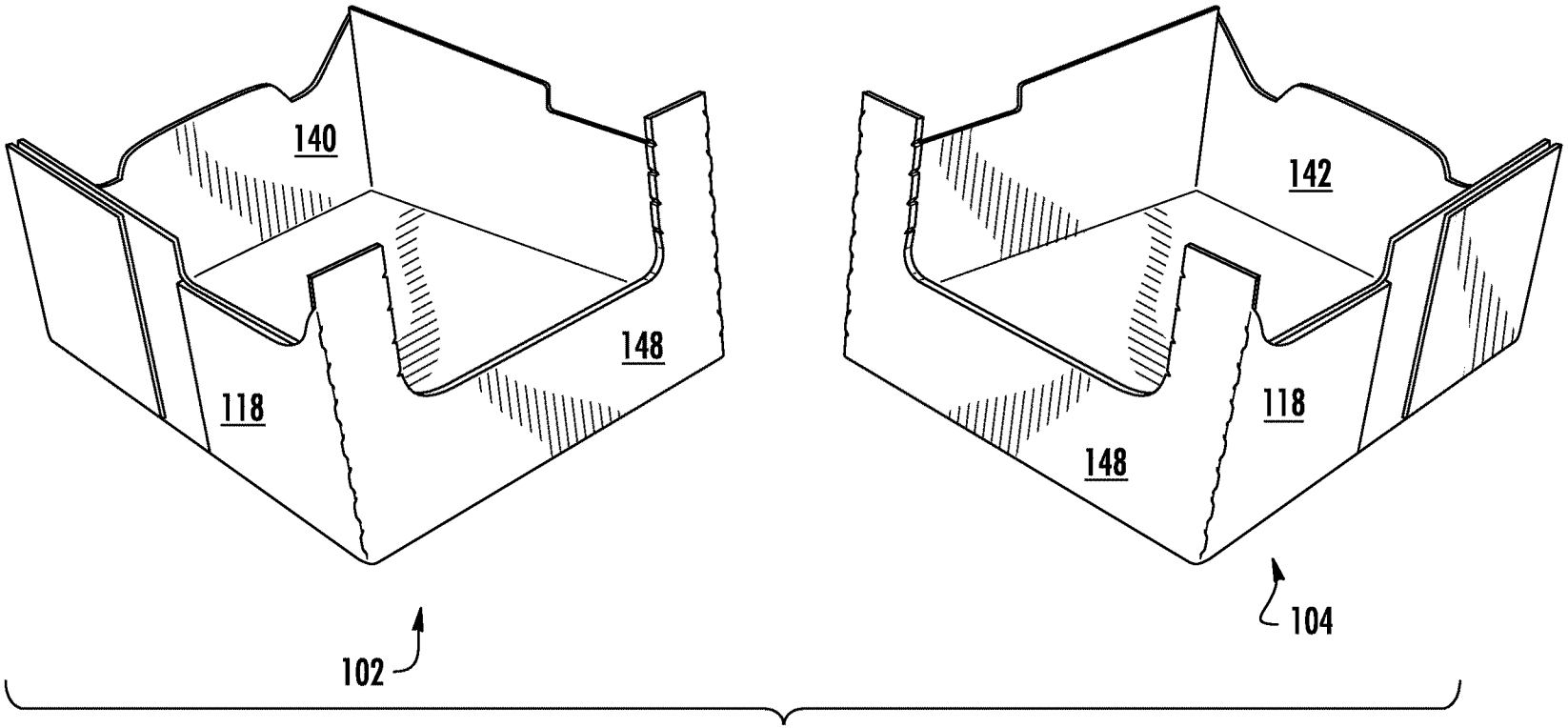
FIG. 8 is a pictorial image of a perspective view of the back side of the first display portion and the second display portion with the vent panel removed in each of the first display portion and the second display portion, according to the exemplary embodiment of FIG. 1.

Referring to FIGS. 7-8, it may be desirable to provide the capability to permit increased refrigerated airflow around the packages of food product in the display portions. According to the illustrated embodiment, vent panels 154, 156 are provided that may be selectively removed to permit enhanced air flow to, and around, the packages. The vent panels 154, 156 are defined by perforated lines that are readily identifiable by stock personnel and are readily removed (e.g. using push-in tabs, etc.). The perforated lines defining the shape of the vent panels are intended to permit removal of a sufficient amount of the display portion walls, while still maintaining the structural integrity of the display portion 102, 104 for holding and displaying the packages. As shown in FIGS. 5-8, removal of the bridge panel 150 reduces the height of the back wall of each display portion 102, 104. Removal of each vent panel 152, 156 further reduces obstruction to air flow around the back of the display portion 102, 104, but retains a corner portion (e.g. post, etc.) on each side to retain structural integrity of the display portion and provide a product support surface for the packages. While the vent panels 154, 156 are shown on the back wall of each display portion, vent panel(s) may also be provided on the side walls according to alternative embodiments.

Figure 9:
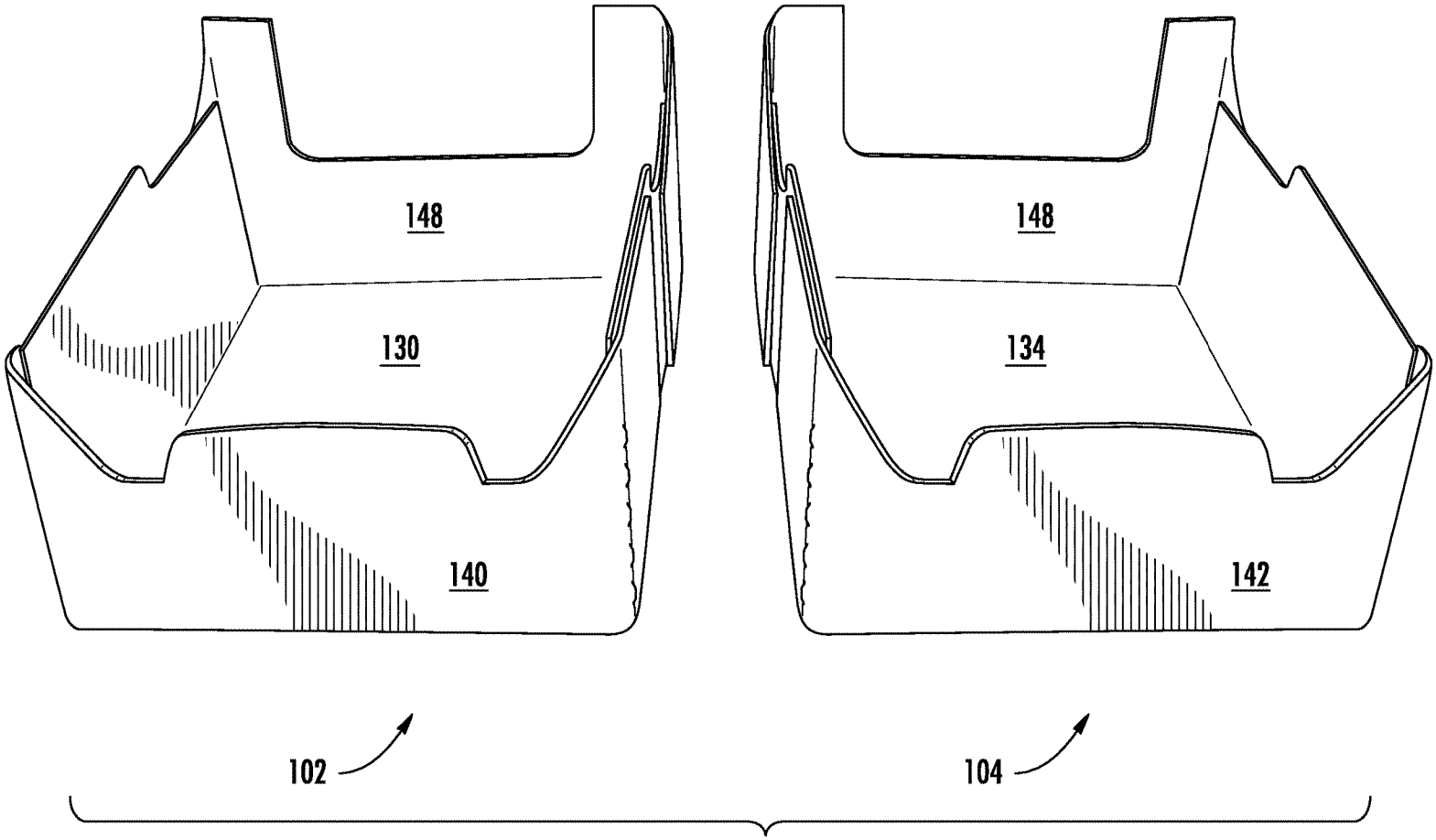
FIG. 9 is a pictorial image of a perspective view of the front side of the first display portion and the second display portion, in a side-by-side display arrangement with the vent panel removed in each of the first display portion and the second display portion, according to the exemplary embodiment of FIG. 1.
Figure 9A:
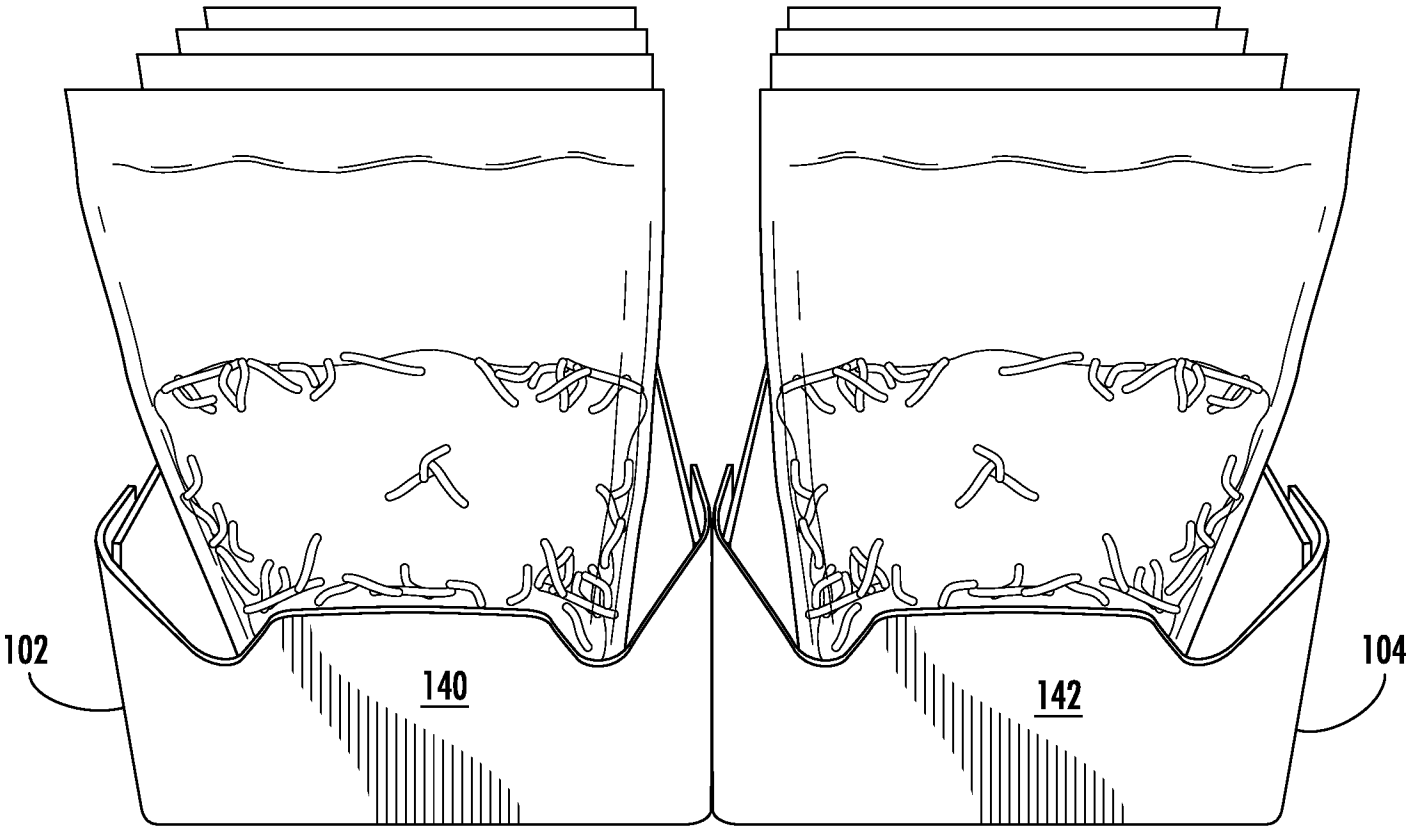
FIG. 9A is a pictorial image of a front view of the front side of the first display portion and the second display portion, in a side-by-side display arrangement with the food packages displayed in each of the first display portion and the second display portion, such that the alternatingly arranged food products separate into their corresponding display portions in an upright orientation, according to the exemplary embodiment of FIG. 1.
Figure 10:
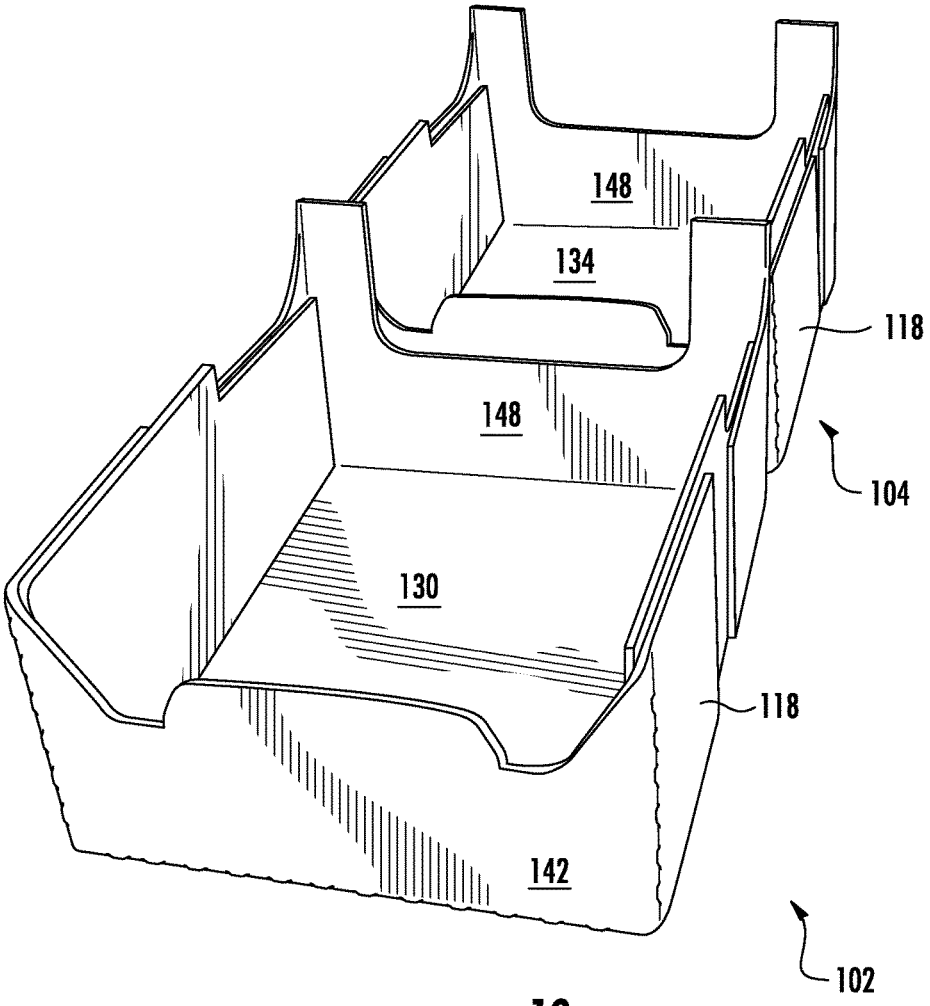
FIG. 10 is a pictorial image of a perspective view of the front side of the first display portion and the second display portion, in a front-to-back display arrangement with the vent panel removed in each of the first display portion and the second display portion, according to the exemplary embodiment of FIG. 1.

Referring to FIGS. 9 and 9A, the first display portion 102 and the second display portion 104 retain the logo area that may be sized, shaped and printed (or otherwise provided with) graphics or other indicia identifying the product and/or manufacturer for enhancing the display. The ability to separate a single case 100 into two separate, vented, display portions 102, 104 permits the display portions to be arranged in a side-by-side manner (FIG. 9) or a front-to-back manner (FIG. 10), as desired for stocking and merchandising purposes. The arrangement of the food product packages in a horizontally flat and alternating (e.g. head-to-toe manner), permits a first half of the packages in the case to separate into one display portion in an upright manner and a second half of the packages in the case to separate into the other display portion in an upright manner upon cracking open the case and separating the display portions.

Figure 11:
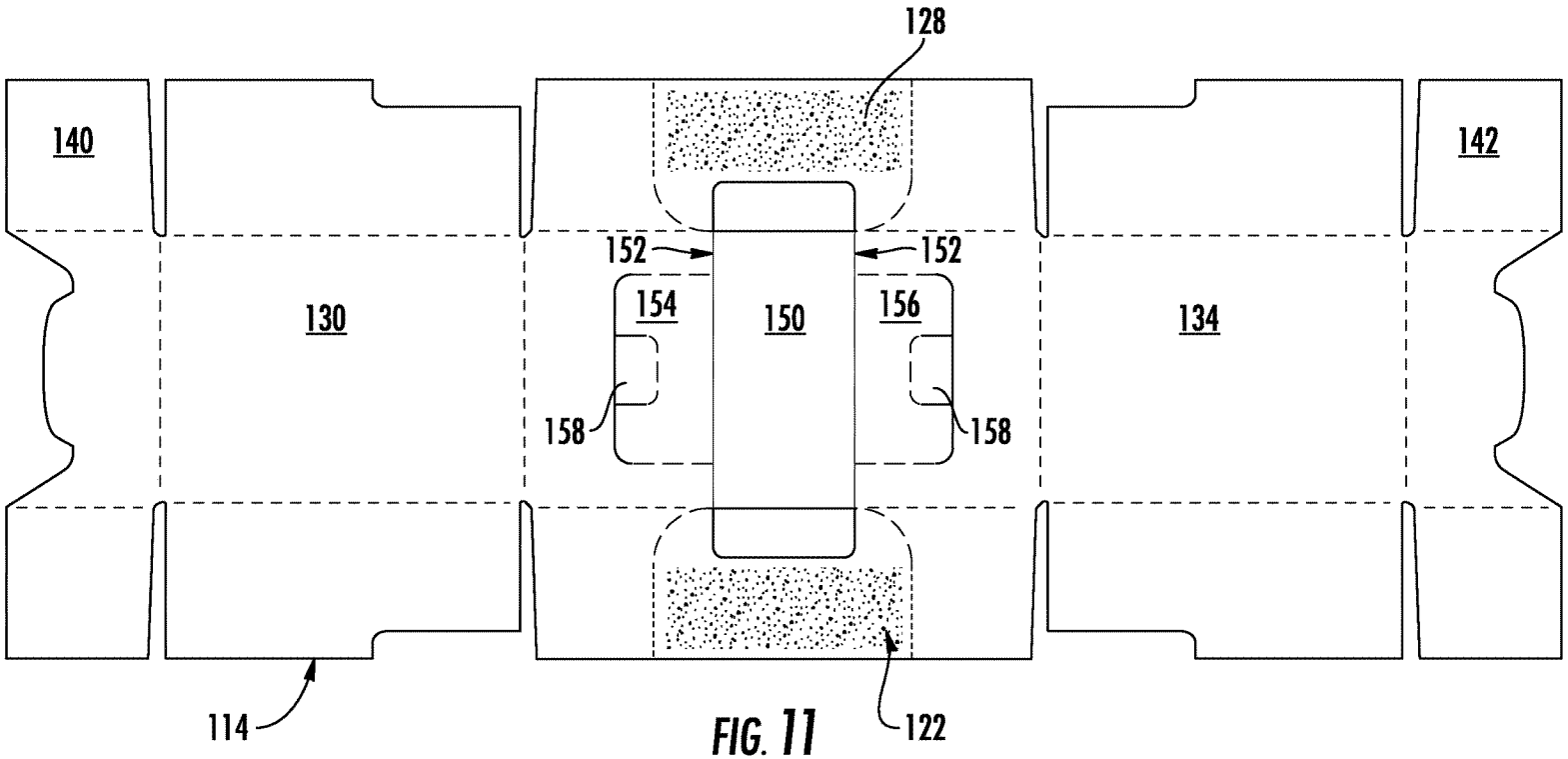
FIG. 11 is a schematic diagram of the first blank for the body of the convertible case for shipping and displaying food products, according to the exemplary embodiment of FIG. 1.
Figure 12:
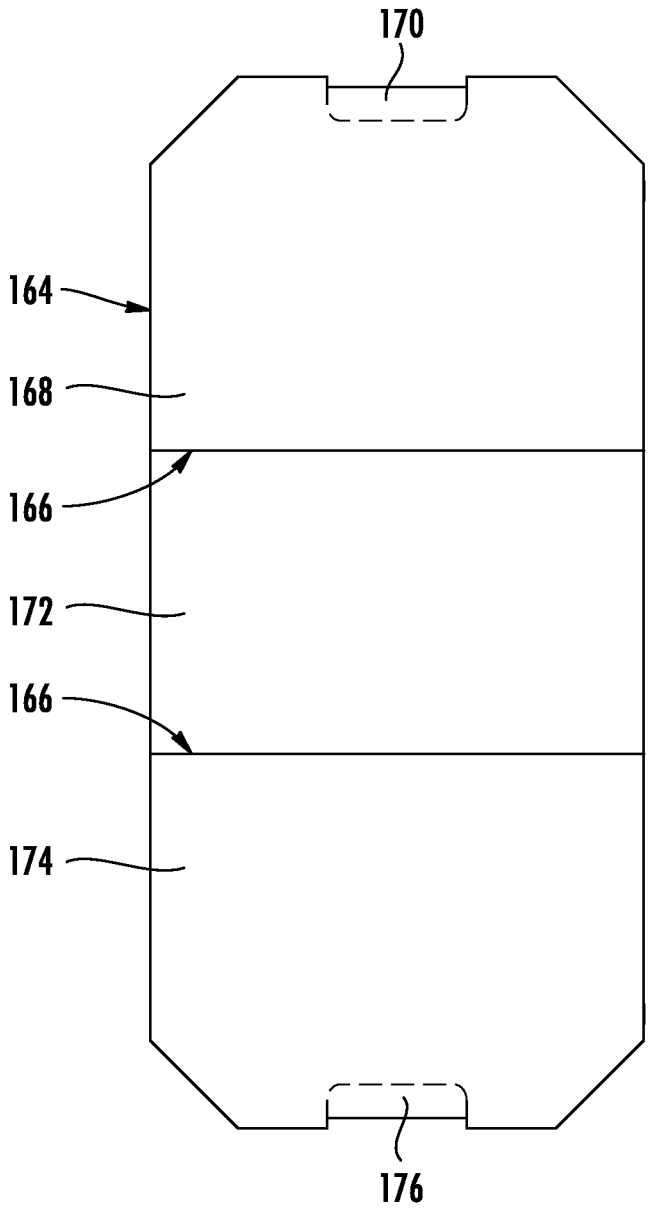
FIG. 12 is a schematic diagram of the second blank for the hood of the convertible case for shipping and displaying food products, according to the exemplary embodiment of FIG. 1.

Specific details and dimensions of a first blank 114 for the body 110 of the case 100 according to the embodiment of FIG. 1 are shown by way of example in FIG. 11. Similarly, specific details and dimensions of a second blank 164 for the hood 160 of the case 100 according to the embodiment of FIG. 1 are shown by way of example in FIG. 12.

[GAP] Referring now more particularly to FIGS. 13-20, a convertible case 200 for shipping and displaying packages of a food product is shown according to another exemplary embodiment. The case includes a body 210 formed from a first blank 214 of a cardboard material and a cover or hood 260 formed from a second blank 264 of a cardboard material. The first blank 214 is foldable into a six-sided rectangular parallelepiped for the body 210 and folded, assembled and filled, using automatic or manual production processes, into a shipping configuration assembly having a front 218 with a partially open region 220 and a removable portion 222 with a glue area, a back 224 having a partially open region 226 and a removable portion 228 having a glue region, a left side 230, a right side 234, a top 238 having a left panel 240 and a right panel 242 that are each shaped to provide a logo area and defining a partially open region 244 between the logo areas, and a bottom 248 having a perforated line 252 disposed substantially across its center, and a first removable vent panel 254 adjacent to a left side of the perforated line 252, and a second removable vent panel 256 adjacent to a right side of the perforated line 252. Each of the vent panels is defined by perforated lines in the general shape of a stepped rectangle. An upper portion 253 of the vent panel extends substantially across the full width of the bottom and then tapers (e.g. along a sloped line, etc.) to a smaller lower portion 255 having a push-in tab 258 that leaves a small remaining portion. Upon subsequent removal of the vent panel, the remaining portion of the bottom 248 provide rear product support surfaces for the display portions. Each of the vent panels is also shown to include push-in tabs 258 intended to facilitate identification and easy removal of the vent panels by stock personnel at a store or other sales facility during subsequent conversion of the case from the shipping configuration to the display configuration.

The second blank 264 is foldable about two parallel hinge lines 266 to form an inverted U-shaped hood 260 having a front panel 268 with a push-in tab 270, a top panel 272 and a back panel 274 having a push-in tab 276, such as previously described with reference to FIGS. 3 and 3A.

Upon arrival of the case at the store, the case may be converted (e.g. by stock personnel, etc.) from the shipping configuration to the display configuration, such that a single case 200 is converted into two separate display portions 202, 204, each display portion holding and displaying approximately one half of the food product packages that were shipped in the case, and configured for placement on a shelf of a refrigerated cooler (or other suitable device).

Figure 14:
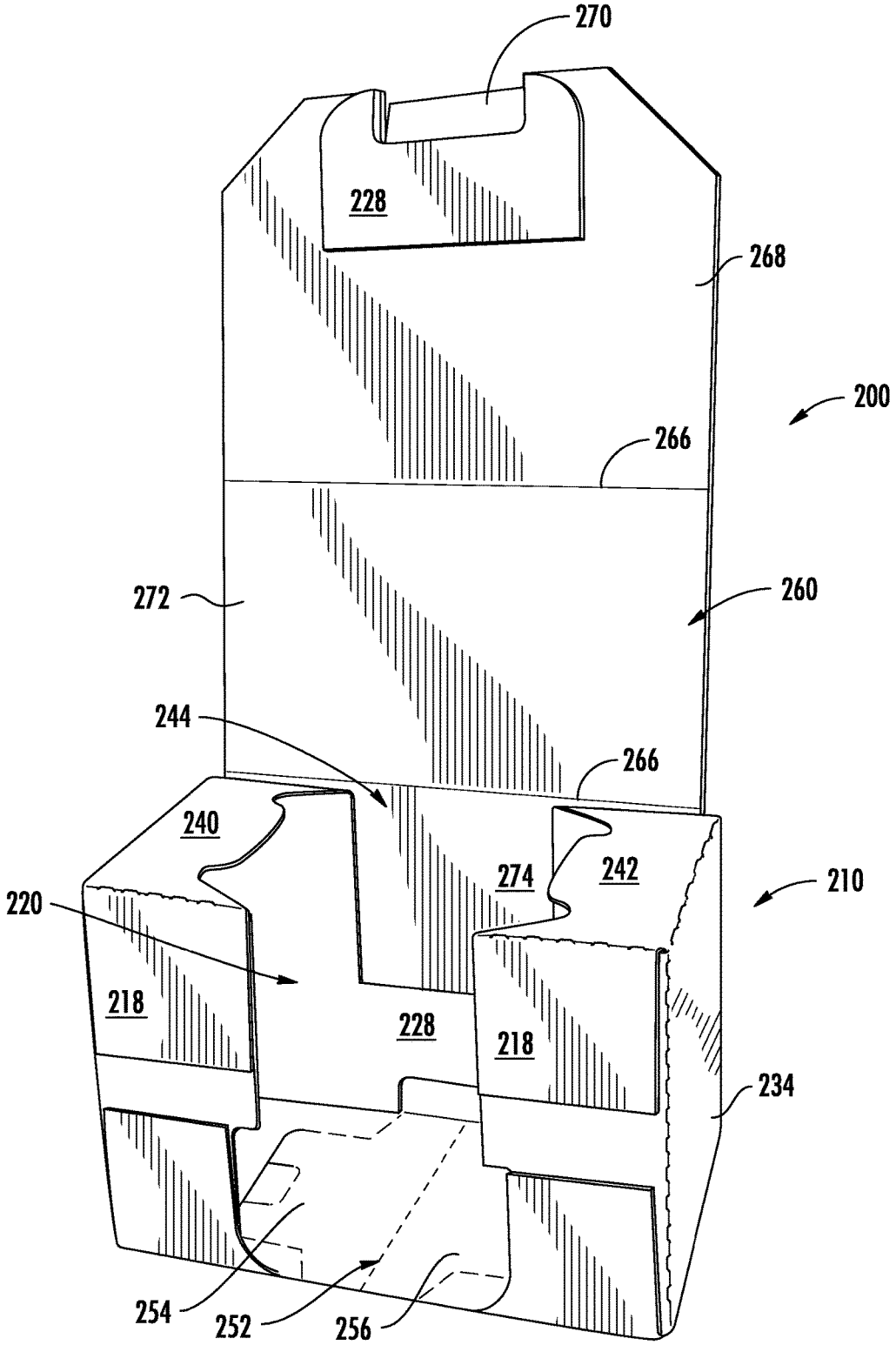
FIG. 14 is a pictorial image of a perspective view of a convertible case for shipping and displaying food products with the front panel and the top panel of the hood detached from the body, according to the exemplary embodiment of FIG. 13. The hood may be substantially similar to the hood embodiment illustrated in FIGS. 3 and 3A.

Referring to FIG. 14, the hood 260 may be detached from the body 210 by depressing the punch-in tabs 270, 276 on the front side and the back side of the hood, then pulling the hood 260 free from the body 210. As the hood 260 detaches from the body 210, the removable portions 222, 228 of the front and back of the body 210 that are adhered to the hood 260 at the glue areas separate from the front 218 and back 248 and are removed with the hood 260 (see FIG. 3).

Figure 15:
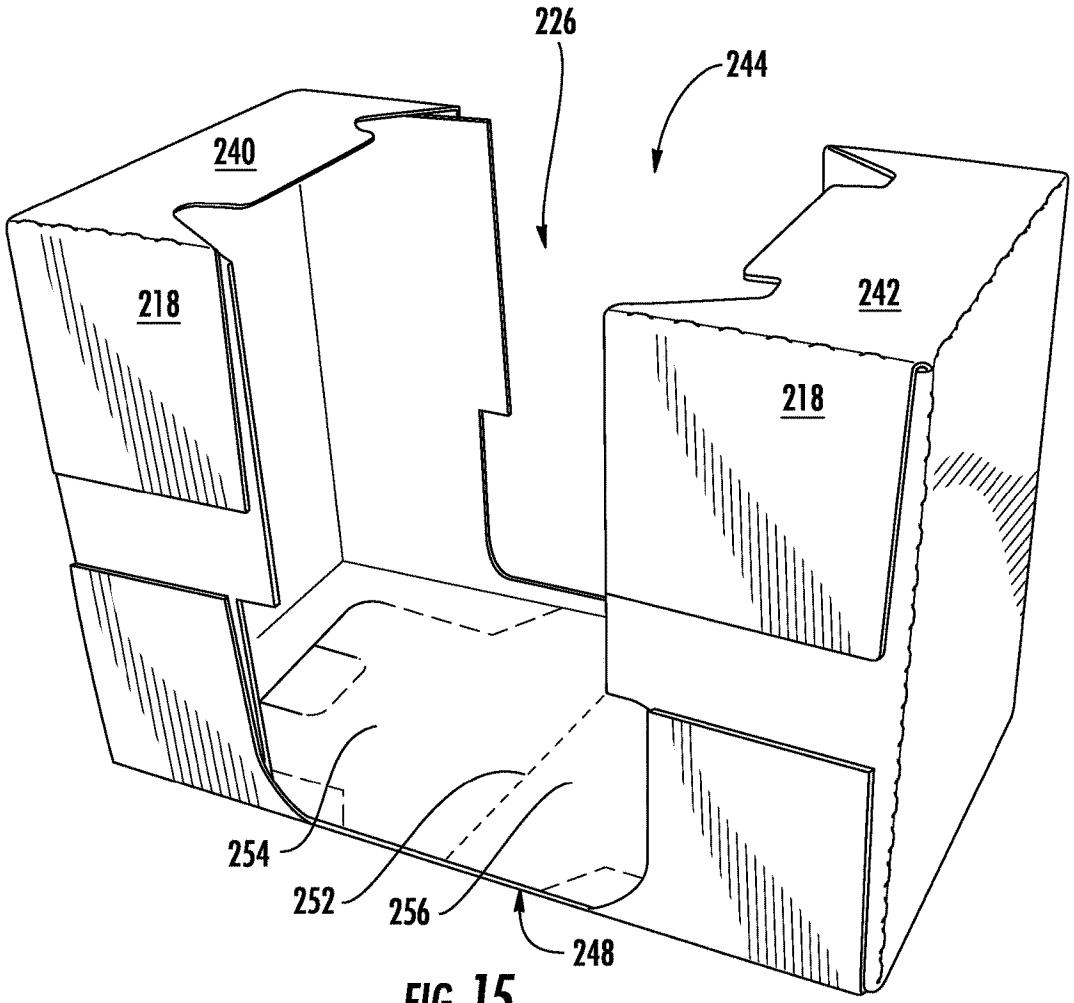
FIG. 15 is a pictorial image of a perspective view of the body of the convertible case for shipping and displaying food products with the hood removed, according to the exemplary embodiment of FIG. 13.
Figure 16:
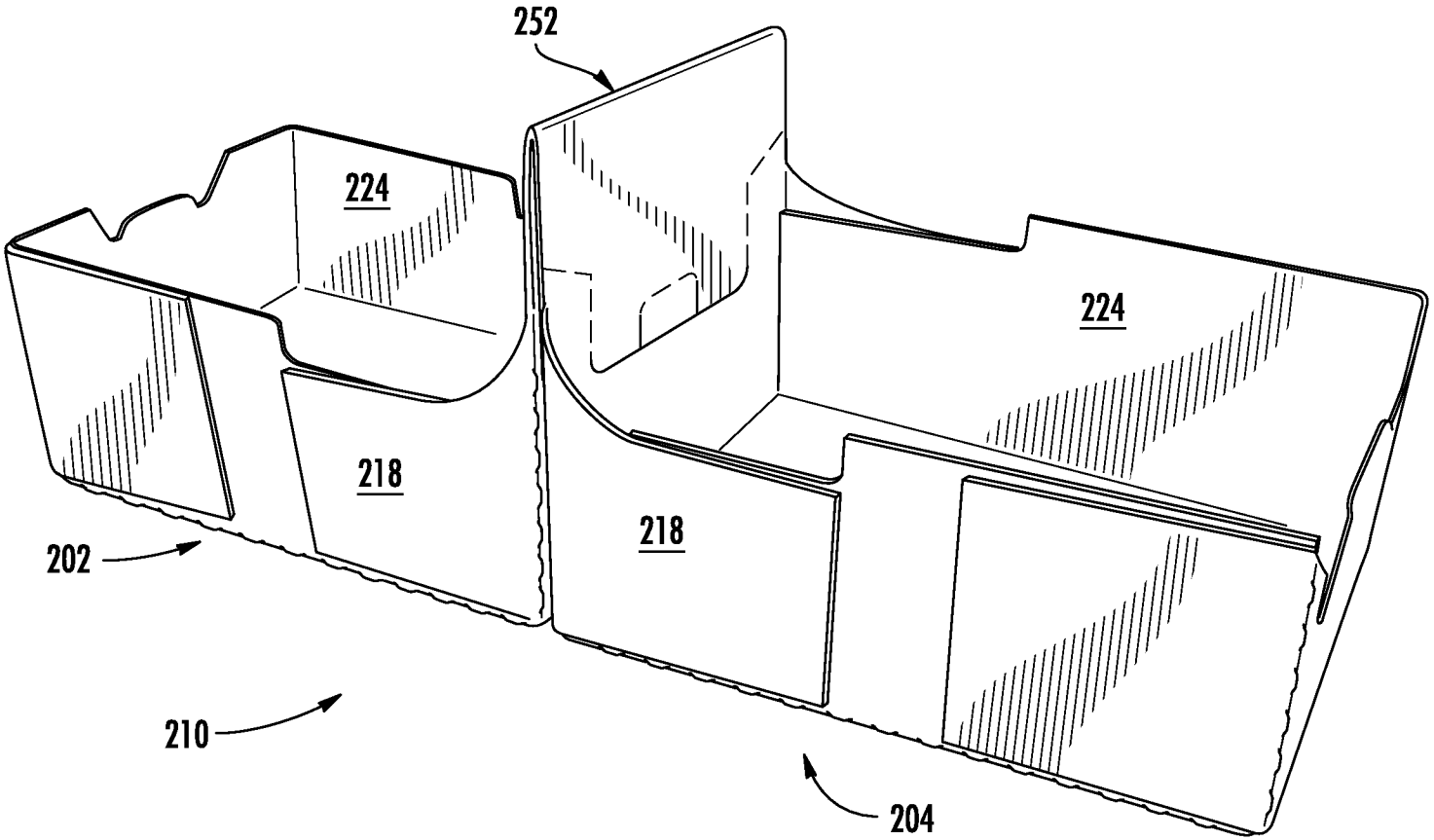
FIG. 16 is a pictorial image of a perspective view of the body of the convertible case for shipping and displaying food products, cracked open into a first display portion and a second display portion that are interconnected by a perforated line centered across the bottom of the body, according to the exemplary embodiment of FIG. 13.
Figure 16A:
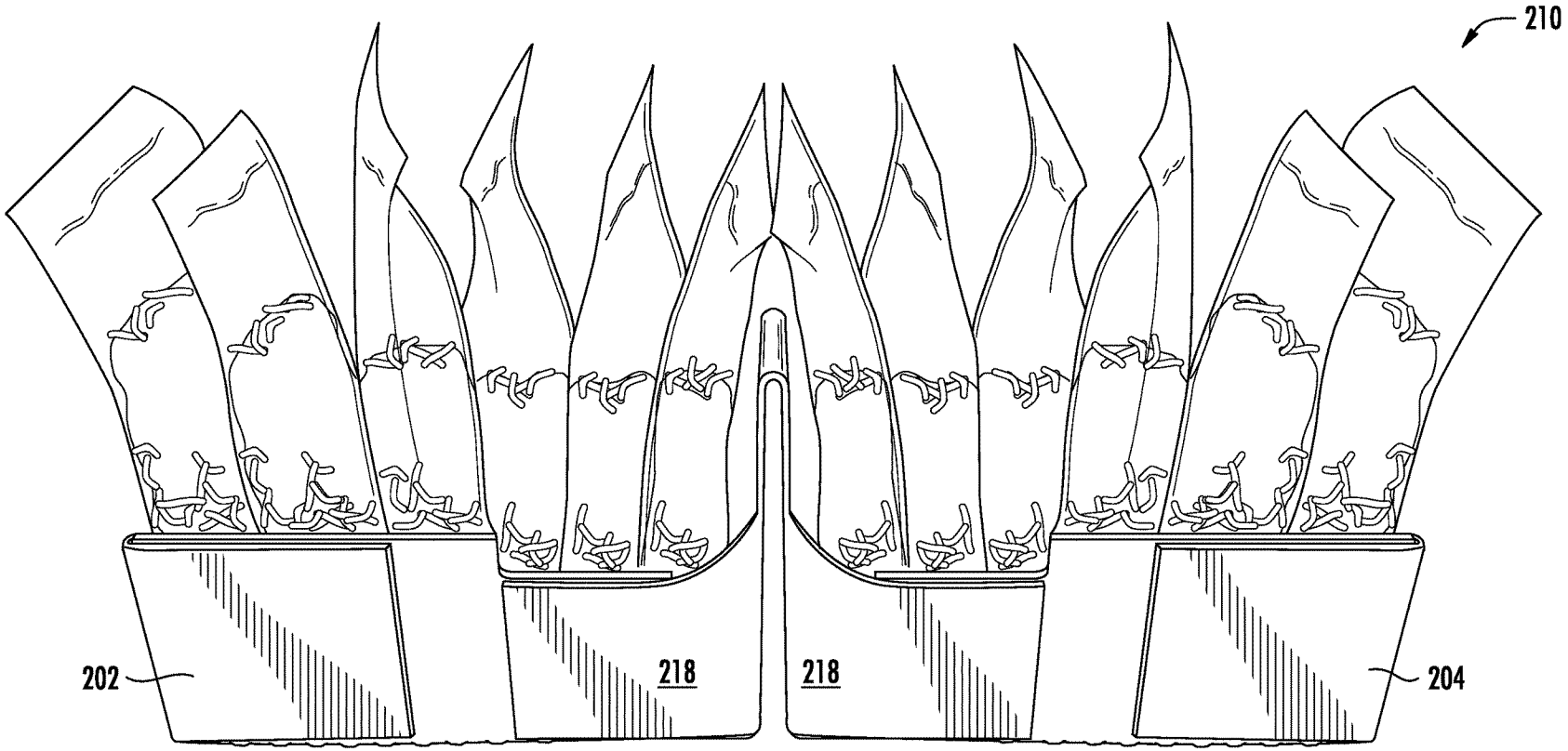
FIG. 16A is a pictorial image of a front perspective view of the body of the convertible case for shipping and displaying food products, cracked open into a first display portion and a second display portion that are interconnected by a perforated line centered across the bottom of the body, and with the food packages displayed in each of the first display portion and the second display portion, such that the alternatingly arranged food products separate into their corresponding display portions in an upright orientation according to the exemplary embodiment of FIG. 13.

Referring to FIGS. 15-16A, each side of the body 210 may be tilted outwardly (e.g. "cracked open" etc.) about the central perforated line 252 on the bottom 248 of the body 210, such that the left 230 and right 234 sides of the body 210 become the bottoms of the first and second display portions 202, 204, and the remaining portions of the bottom 248 of the body 210 become the backs of the first and second display portions 202, 204, and the first and second logo areas on the top 218 of the body 210 become the fronts of the first and second display portions 202, 204, respectively. With the case cracked open to its display orientation with the first and second display portions, the perforation line 252 may be separated to form the two display portions 202, 204. As shown in FIG. 16A, the arrangement of the food product packages in a horizontally flat and alternating (e.g. head-to-toe manner), permits a first half of the packages in the case to separate into one display portion in an upright manner and a second half of the packages in the case to separate into the other display portion in an upright manner upon cracking open the case and separating the display portions.

Figure 17:
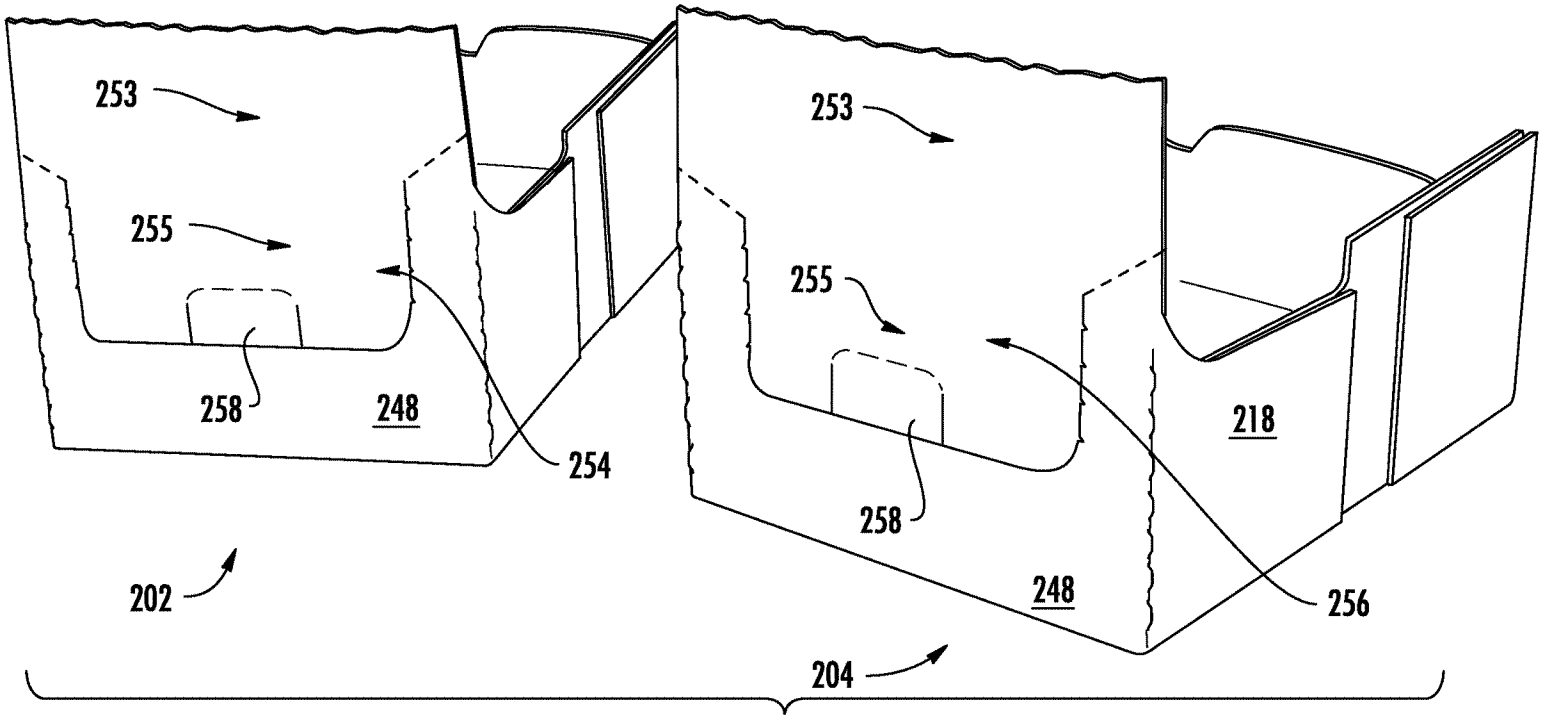
FIG. 17 is a pictorial image of a perspective view of a back side of the first display portion and the second display portion following separation at the perforated line, according to the exemplary embodiment of FIG. 13.
Figure 18:
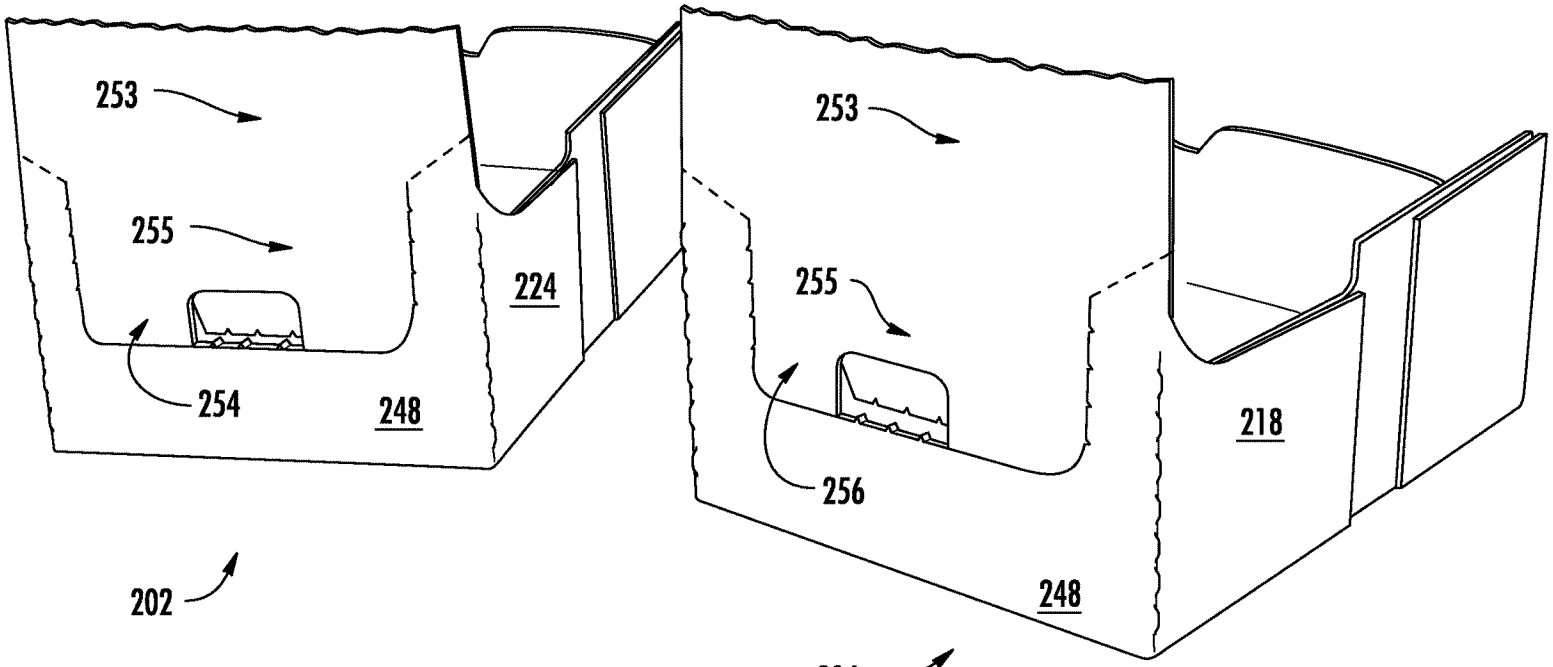
FIG. 18 is a pictorial image of a perspective view of the back side of the first display portion and the second display portion with a push-in tab deployed on a vent panel in each of the first display portion and the second display portion, according to the exemplary embodiment of FIG. 13.
Figure 19:
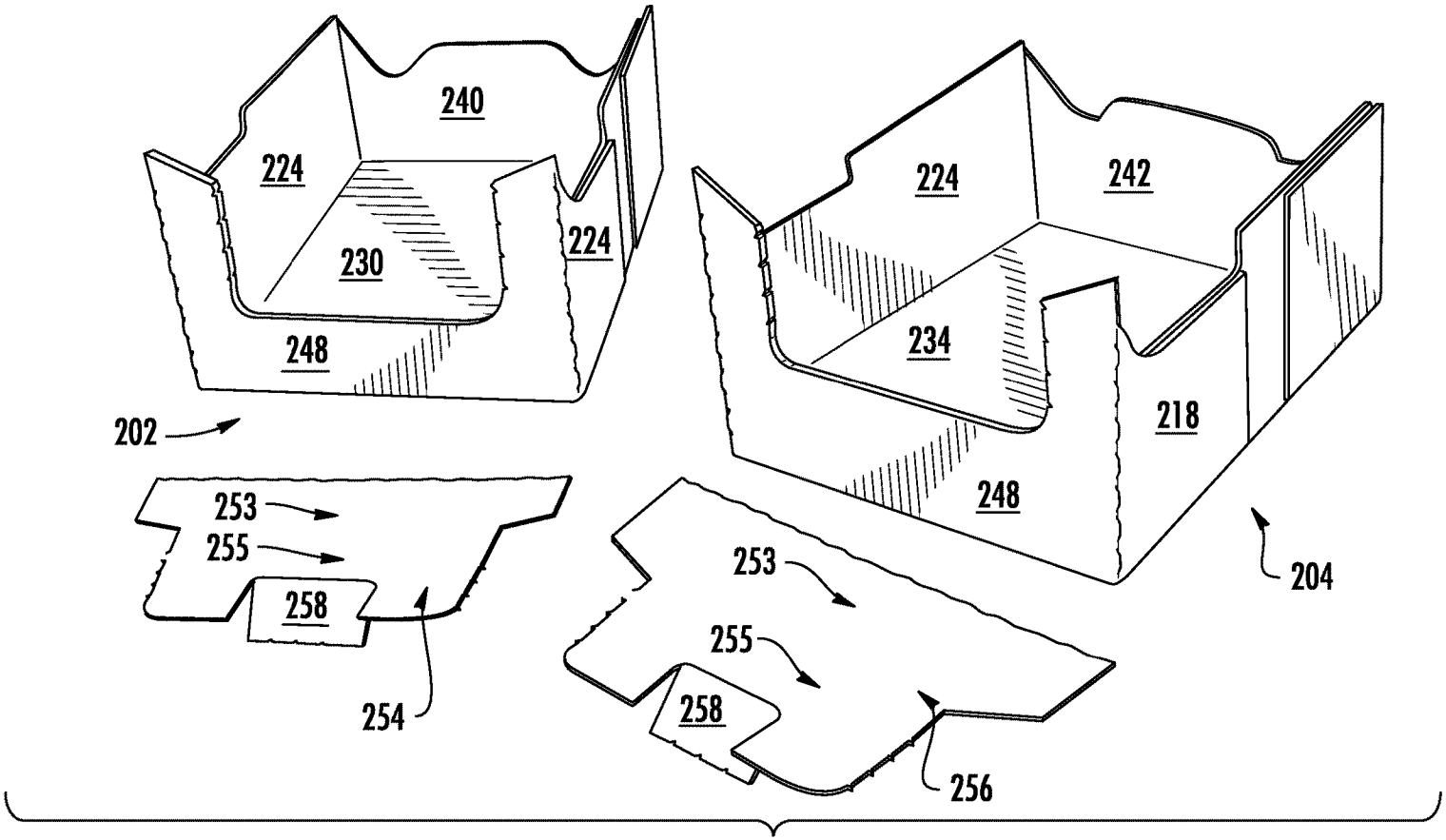
FIG. 19 is a pictorial image of a perspective view of the back side of the first display portion and the second display portion with the vent panel removed in each of the first display portion and the second display portion, according to the exemplary embodiment of FIG. 13. The first display portion and the second display portion, may be arranged in a side-by-side display arrangement or in a front-to-back display arrangement, in a manner similar to that shown in FIGS. 9, 9A and 10.

Referring to FIGS. 17-19, it may be desirable to provide the capability to permit increased refrigerated airflow around the packages of food product in the display portions 202, 204. According to the illustrated embodiment, vent panels 254, 256 are provided that may be selectively removed to permit enhanced air flow to, and around, the food packages. The vent panels 254, 256 are defined by perforated lines that are readily identifiable by stock personnel and may be readily removed using push-in tabs 258. The perforated lines defining the shape of the vent panels are intended to permit removal of a sufficient amount of the display portion walls, while still maintaining the structural integrity of the display portion for holding and displaying the packages. As shown in FIG. 19, removal of each vent portion reduces the height of the back wall of each display portion and further reduces obstruction to air flow around the back of the display portion, but retains a corner portion (e.g. post, etc.) on each side to retain structural integrity of the display portion and provide a product support surface for the packages. While the vent panels 254, 256 are shown on the back wall of each display portion, vent panel(s) may also be provided on the side walls according to alternative embodiments.

As previously described, the first display portion 202 and the second display portion 204 retain the logo area that may be sized, shaped and printed (or otherwise provided with) graphics or other indicia identifying the product and/or manufacturer for enhancing the display. The ability to separate a single case 200 into two separate, vented, display portions 202, 204 permits the display portions to be arranged in a side-by-side manner or a front-to-back manner, as desired for stocking and merchandising purposes.

Figure 13:
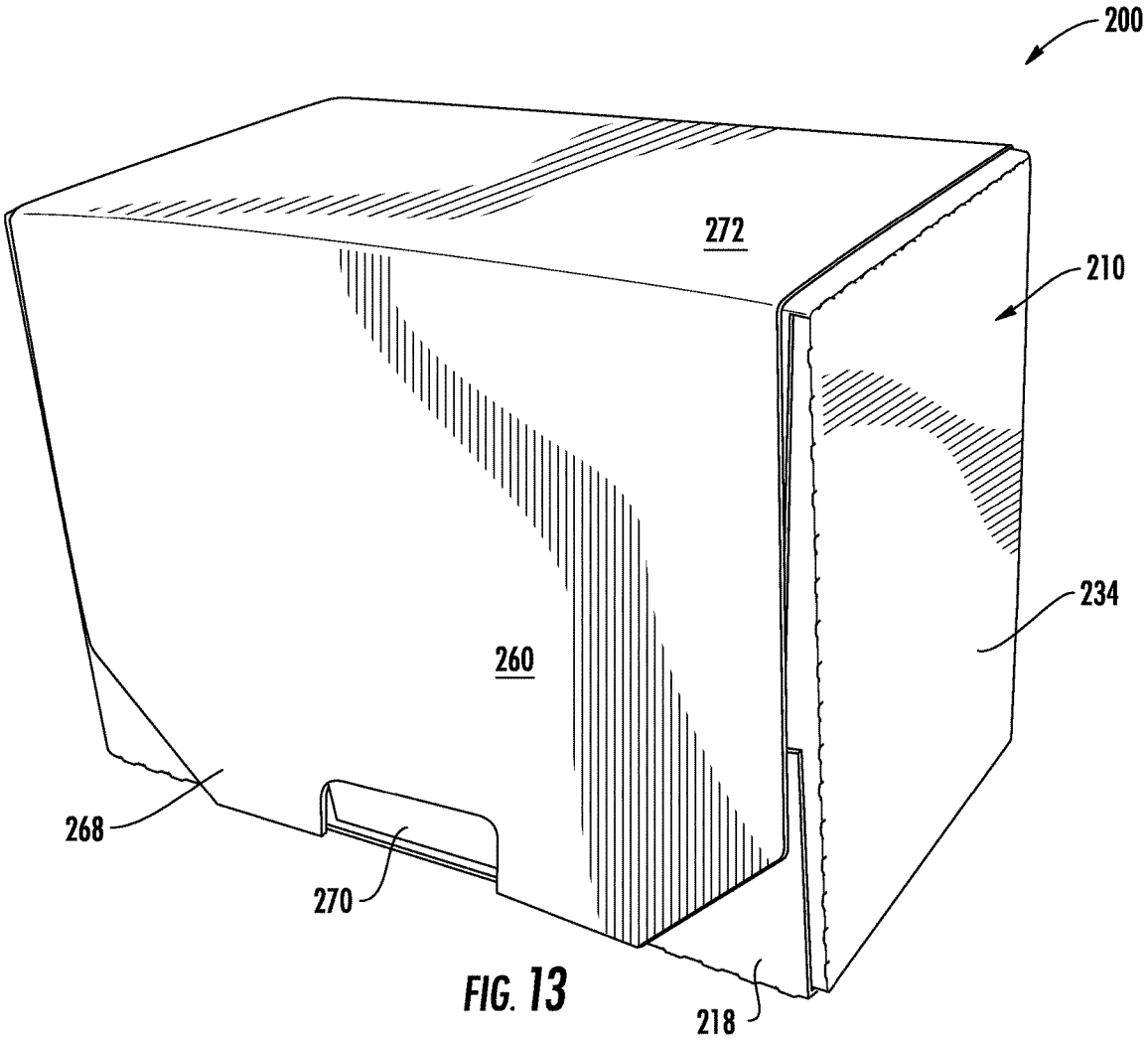
FIG. 13 is a pictorial image of a perspective view of a convertible case for shipping and displaying food products with the hood attached to the body in the shipping configuration, according to another exemplary embodiment.
Figure 20:
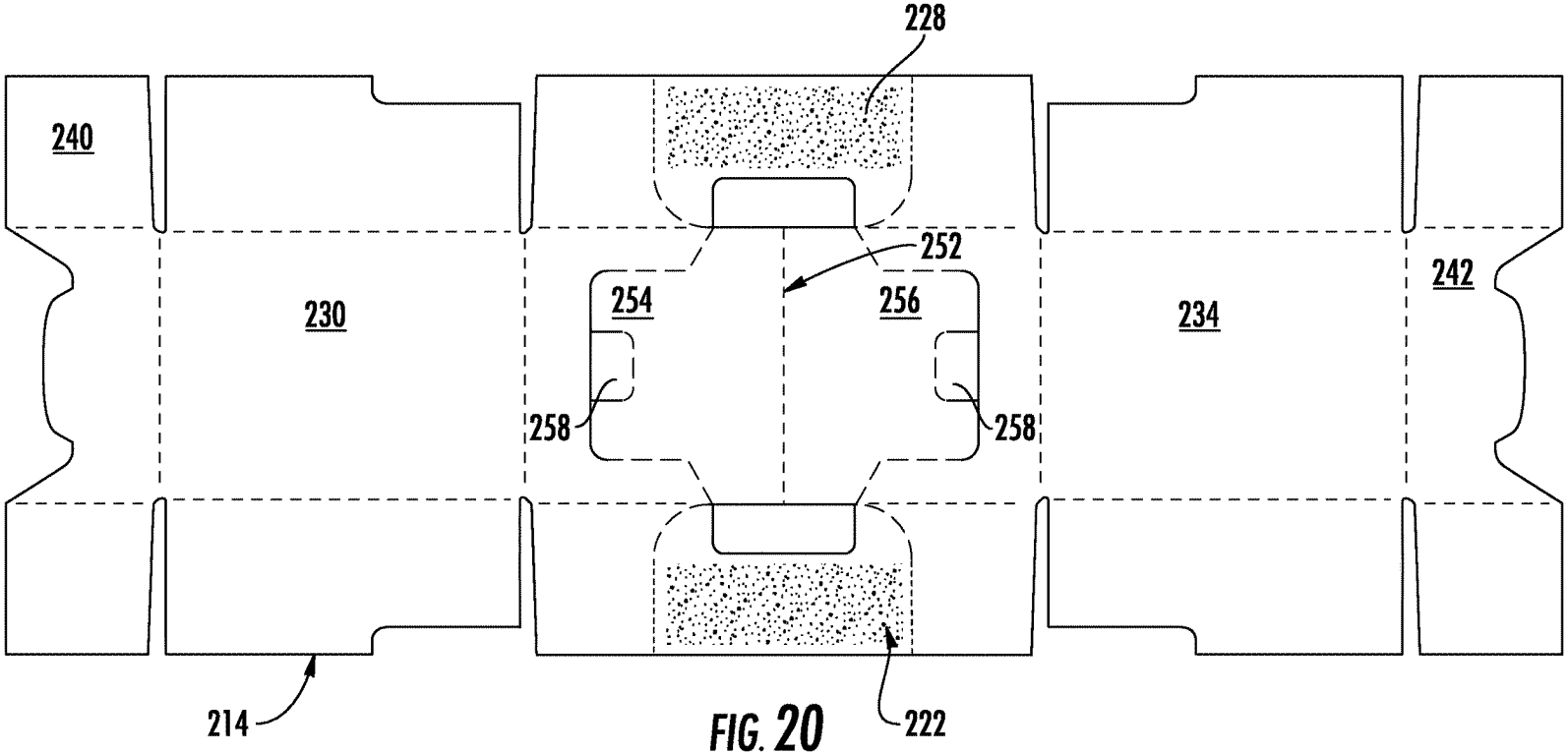
FIG. 20 is a schematic diagram of the first blank for the body of the convertible case for shipping and displaying food products, according to the exemplary embodiment of FIG. 13. The second blank for the hood may be the same or similar to that shown in FIG. 12.

Specific details and dimensions of a first blank 214 for the body of the case according to the embodiment of FIG. 13 are shown by way of example in FIG. 20. Similarly, specific details and dimensions of a second blank 264 for the hood 260 of the case 200 according to the embodiment of FIG. 13 may be the same or similar to those shown by way of example in FIG. 12.

[TAB] Referring now more particularly to FIGS. 21-27, a convertible case 300 for shipping and displaying packages of a food product is shown according to another exemplary embodiment. The case 300 includes a body 310 formed from a first blank 314 of a cardboard material and a cover or hood 360 formed from a second blank 364 of a cardboard material. The first blank 314 is foldable into a six-sided rectangular parallelepiped for the body 310 and folded, assembled and filled, using automatic or manual production processes, into a shipping configuration assembly having a front 318 with a partially open region 320 and a removable portion 322 with a glue area, a back 324 having a partially open region 326 and a removable portion 328 having a glue region, a left side 330, a right side 334, a top 338 having a left panel 340 and a right panel 342 that are each shaped to provide a logo area and defining a partially open region 344 between the logo areas, and a bottom 348 having two outer perforated line segments 352 disposed substantially across its center, and an approximately S-shaped perforated line 353 adjoining and each of the perforated line segments 352. A first removable vent panel 354 is provided adjacent to a left side of the perforated lines 352, 353, and a second removable vent panel 356 is provided adjacent to a right side of the perforated lines 352, 353. Each of the vent panels is defined by perforated lines in a general "L" shape. Upon subsequent removal of the vent panel, the remaining portion of the bottom 348 provides rear product support surfaces for the display portions. Each of the vent panels may include push-in tabs (not shown) that are intended to facilitate identification and easy removal of the vent panels by stock personnel at a store or other sales facility during subsequent conversion of the case from the shipping configuration to the display configuration. Alternatively, the upwardly extending "leg" 355 of each of the L shaped portions intended to provide a "tab" for gripping and removing (e.g. tearing along the perforated lines) the vent panel 354, 356 from the bottom of the case.

The second blank 364 is foldable about two parallel hinge lines 366 to form an inverted U-shaped hood 360 having a front panel 368 with a push-in tab 370, a top panel 372 and a back panel 374 having a push-in tab 376, such as previously described with reference to FIGS. 3 and 3A.

Upon arrival of the case at the store, the case 300 may be converted (e.g. by stock personnel, etc.) from the shipping configuration to the display configuration, such that a single case 300 is converted into two separate display portions 302, 304, each display portion holding and displaying approximately one half of the food product packages that were shipped in the case, and configured for placement on a shelf of a refrigerated cooler (or other suitable device). The arrangement of the food product packages in a horizontally flat and alternating (e.g. head-to-toe manner), permits a first half of the packages in the case to separate into one display portion in an upright manner and a second half of the packages in the case to separate into the other display portion in an upright manner upon cracking open the case and separating the display portions.

Figure 22:
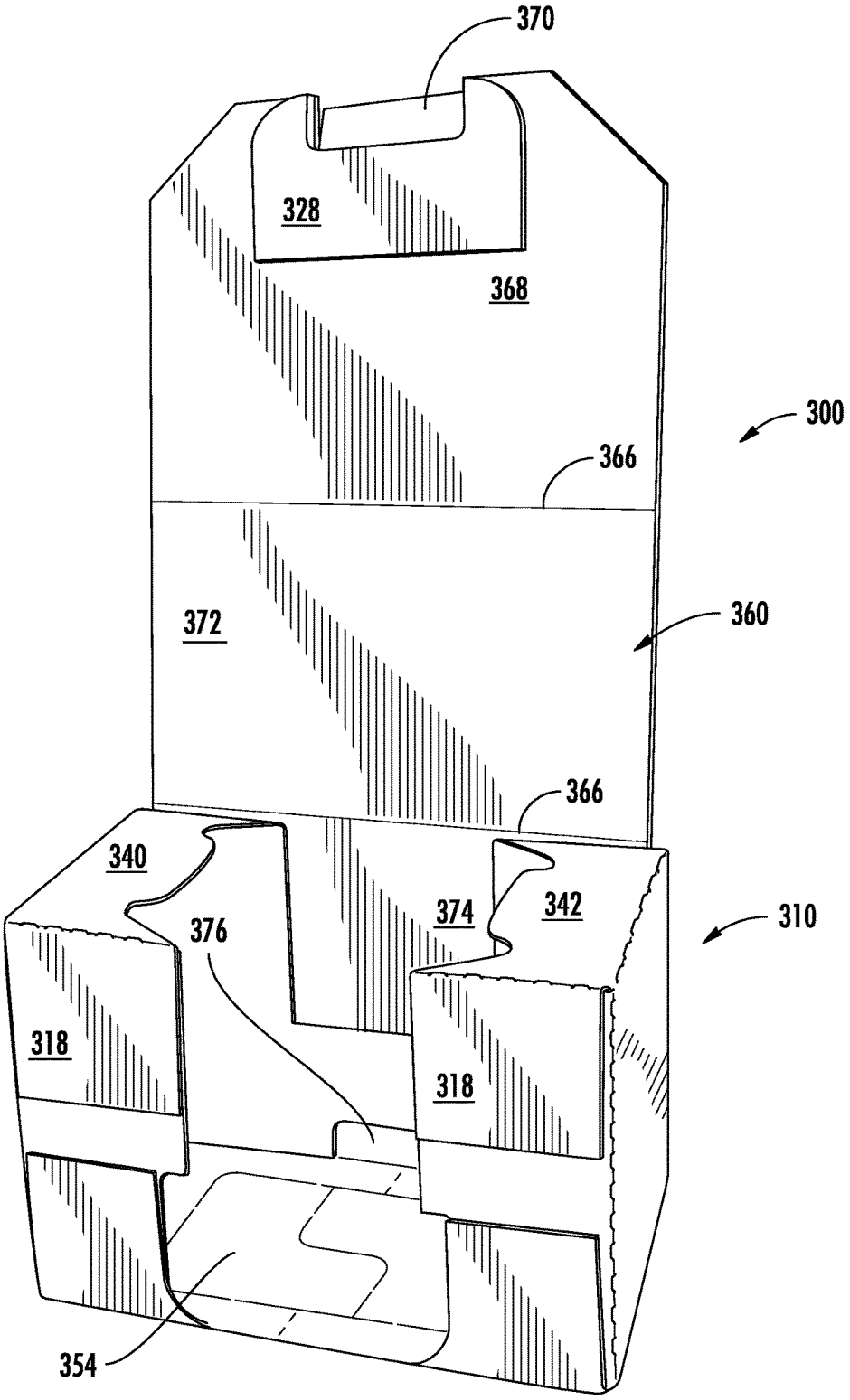
FIG. 22 is a pictorial image of a perspective view of a convertible case for shipping and displaying food products with the front panel and the top panel of the hood detached from the body, according to the exemplary embodiment of FIG. 21. The hood may be substantially similar to the hood embodiment illustrated in FIGS. 3 and 3A.

Referring to FIG. 22, the hood 360 may be detached from the body 310 by depressing the punch-in tabs 370, 376 on the front side 368 and the back side 374 of the hood 360, then pulling the hood 360 free from the body 310. As the hood detaches from the body, the removable portions 322, 328 of the front 318 and back 324 of the body 310 that are adhered to the hood 360 at the glue areas separate from the front and back and are removed with the hood (see FIGS. 3 and 3A).

Figure 23:
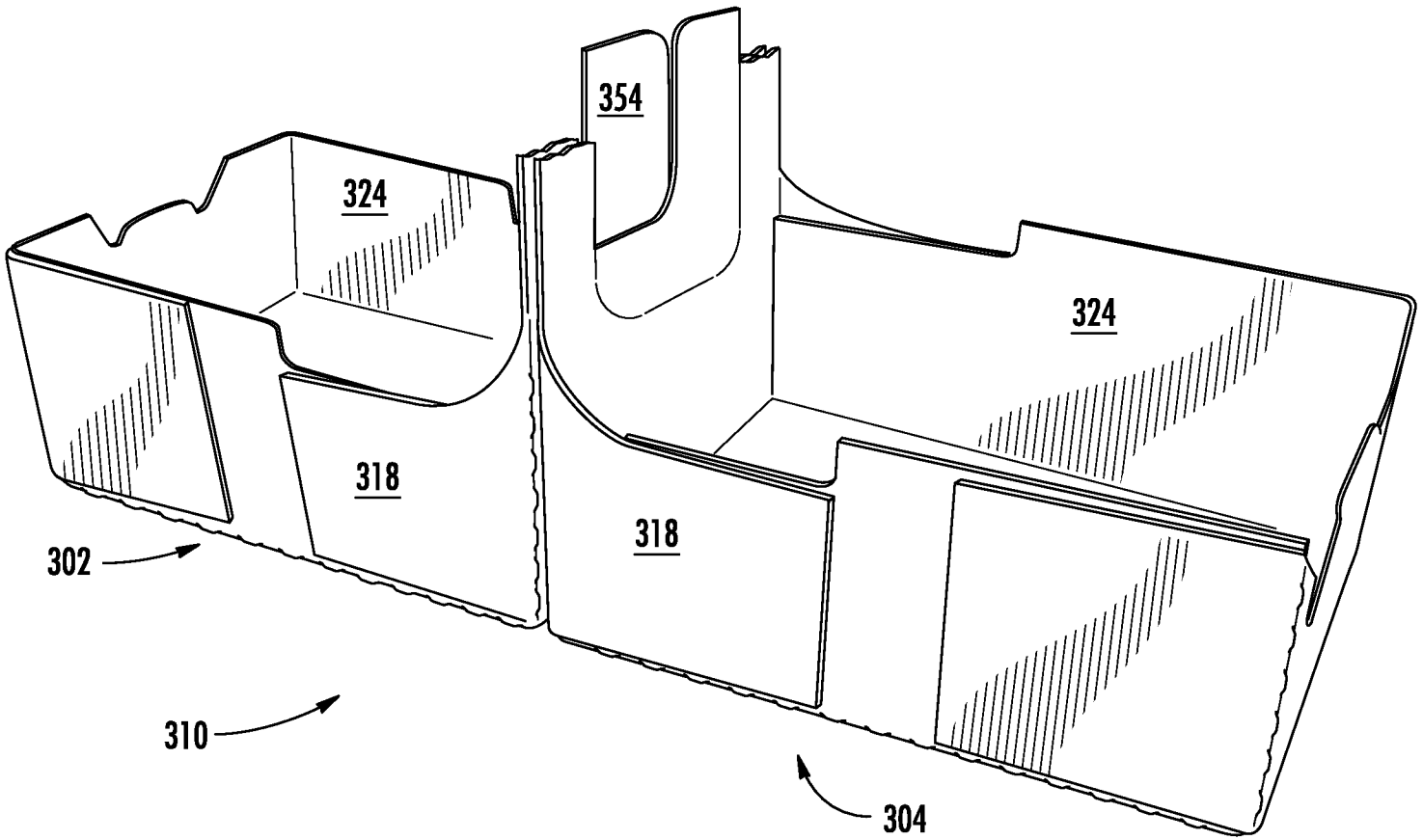
FIG. 23 is a pictorial image of a perspective view of the body of the convertible case for shipping and displaying food products, cracked open into a first display portion and a second display portion that are interconnected by two straight perforated line segments centered across the bottom of the body and by an approximately "S" shaped perforated line, according to the exemplary embodiment of FIG. 21.
Figure 24:
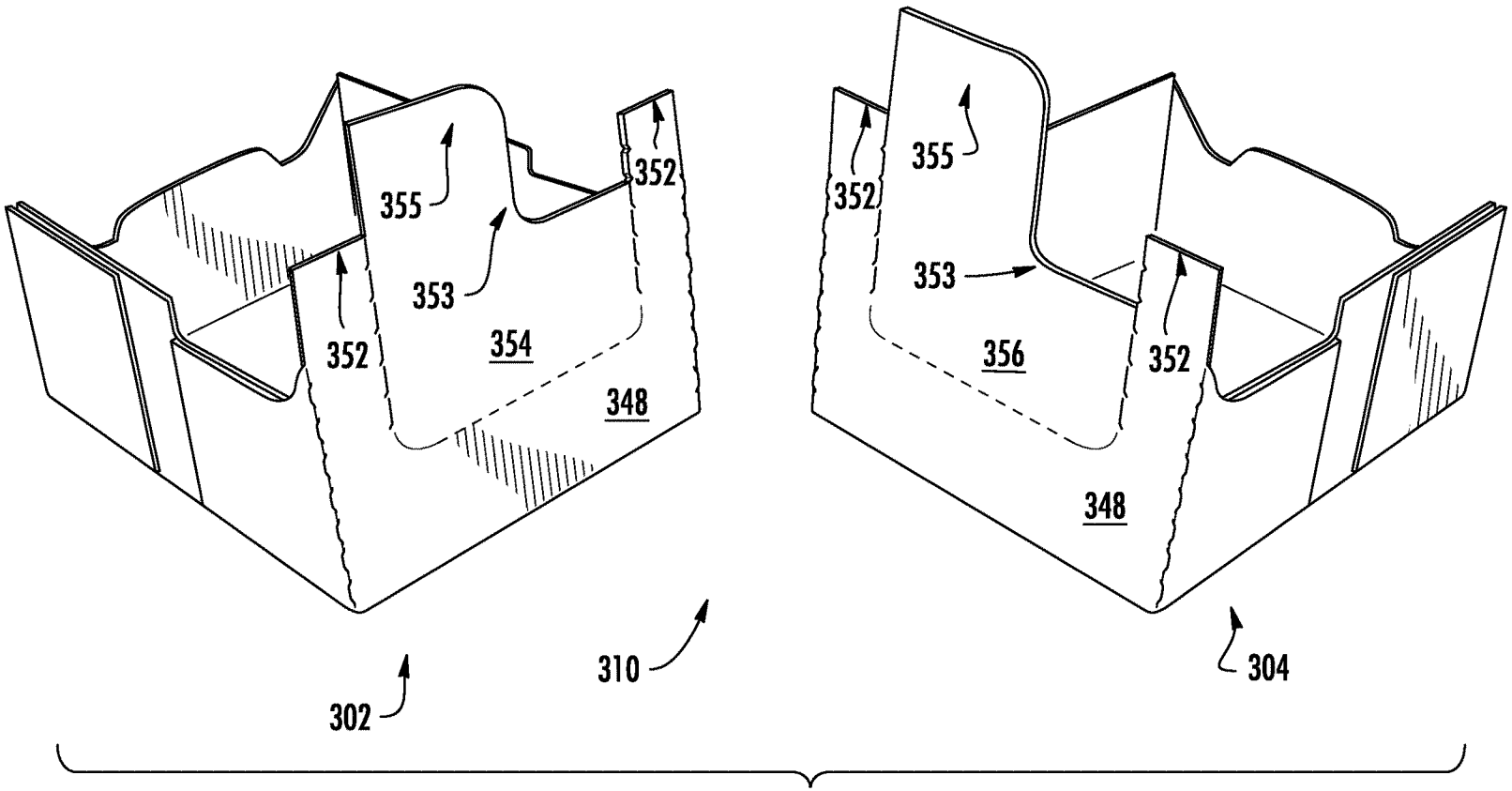
FIG. 24 is a pictorial image of a perspective view of a back side of the first display portion and the second display portion following separation at the perforated line segments and the S-shaped perforated line, according to the exemplary embodiment of FIG. 21.

Referring to FIGS. 23-24, each side of the body 310 may be tilted outwardly (e.g. "cracked open" etc.) about the central perforated line segments 352, 353 on the bottom 348 of the body 310, such that the left 330 and right 334 sides of the body 310 become the bottoms of the first and second display portions 302, 304, and the remaining portions of the bottom 348 of the body 310 become the backs of the first and second display portions 302, 304, and the first and second logo areas on the top 338 of the body become the fronts of the first and second display portions 302, 304, respectively. With the case 300 cracked open to its display orientation with the first and second display portions 302, 304, the perforation lines 352, 353 may be separated to form the two display portions 302, 304.

Figure 25:
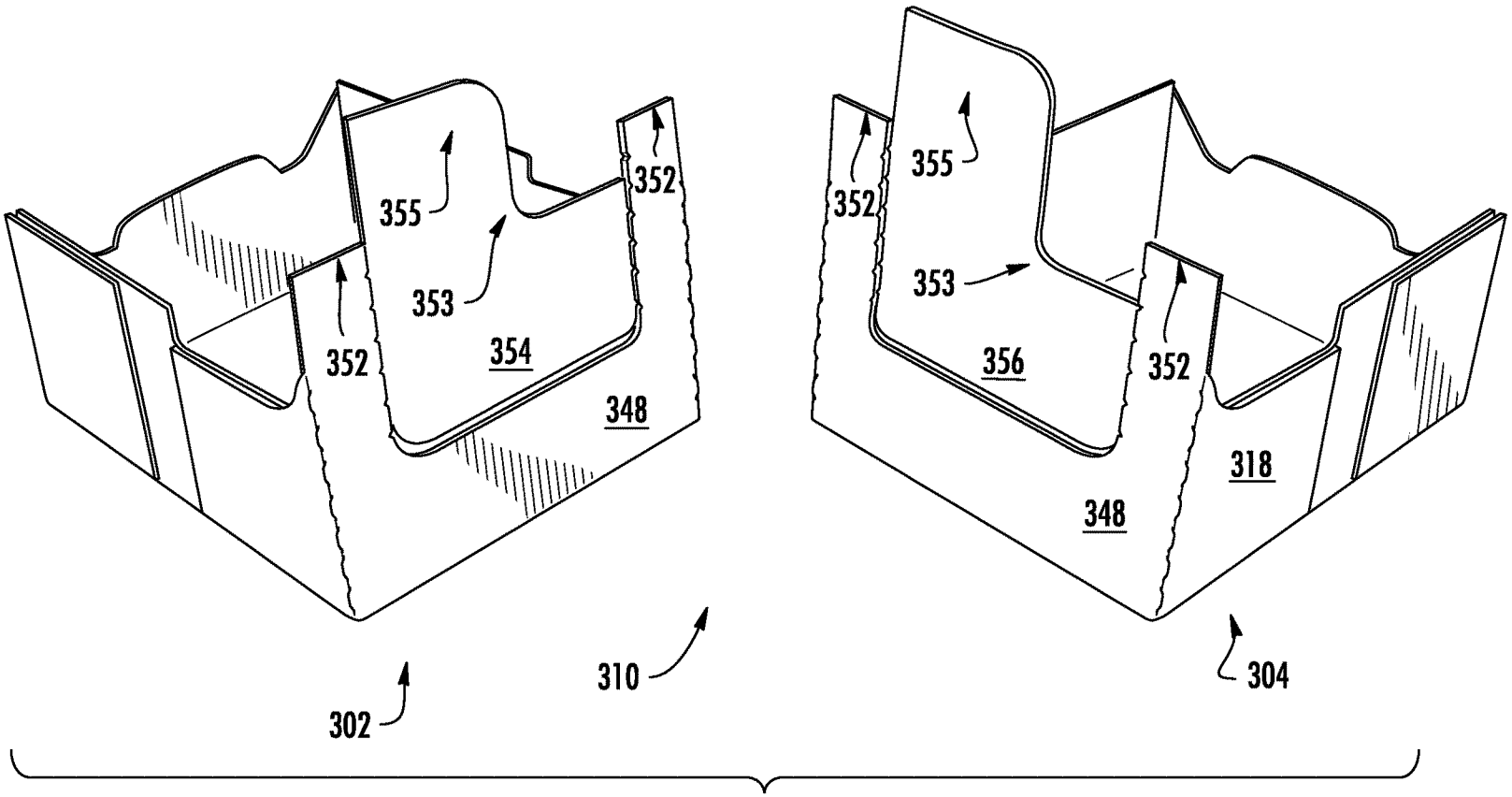
FIG. 25 is a pictorial image of a perspective view of the back side of the first display portion and the second display portion with a vent panel in each of the first display portion and the second display portion, according to the exemplary embodiment of FIG. 21.
Figure 26:
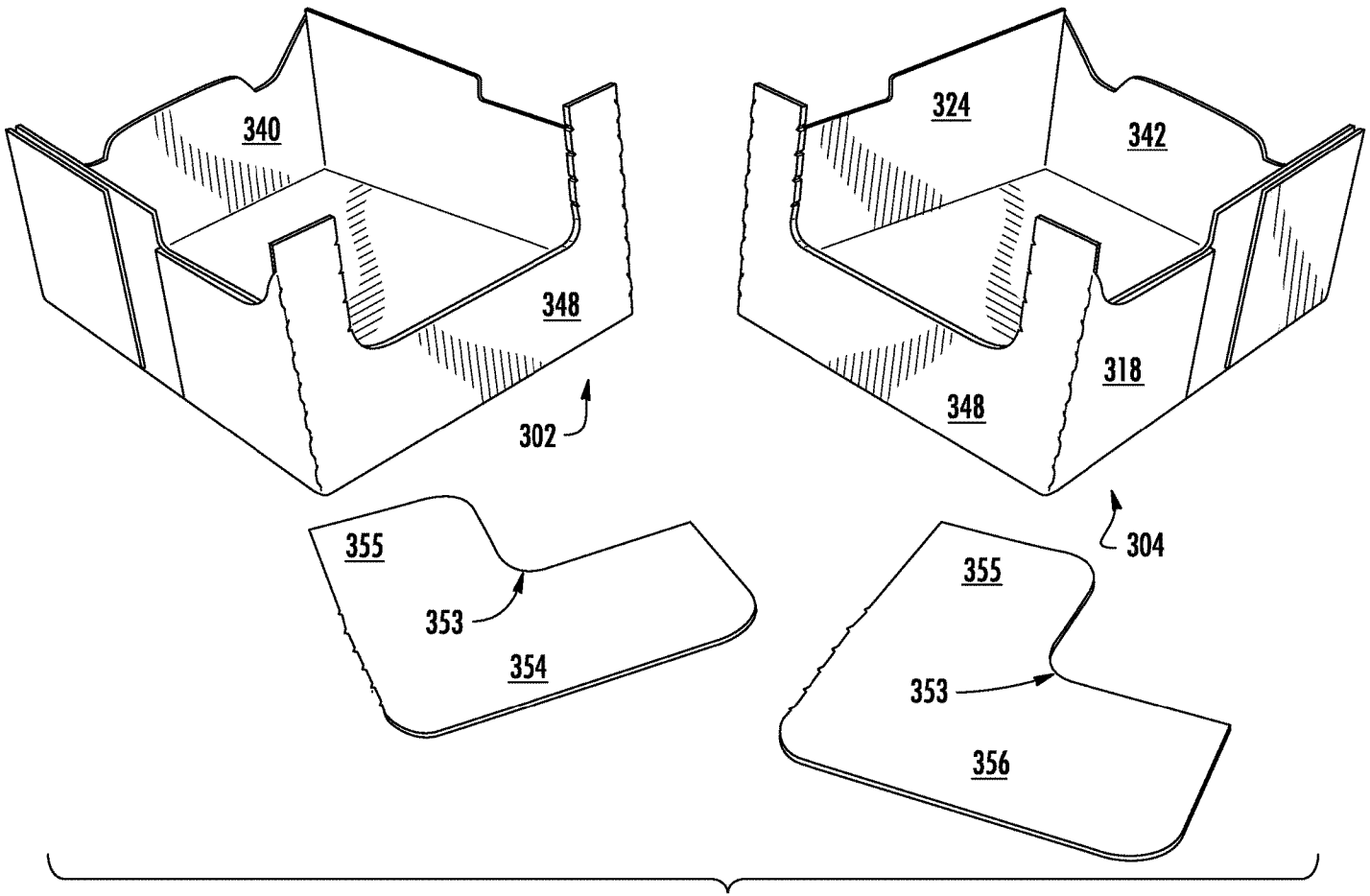
FIG. 26 is a pictorial image of a perspective view of the back side of the first display portion and the second display portion with the vent panel removed in each of the first display portion and the second display portion, according to the exemplary embodiment of FIG. 21. The first display portion and the second display portion, may be arranged in a side-by-side display arrangement or in a front-to-back display arrangement, in a manner similar to that shown in FIGS. 9, 9A and 10.
Figure 27:
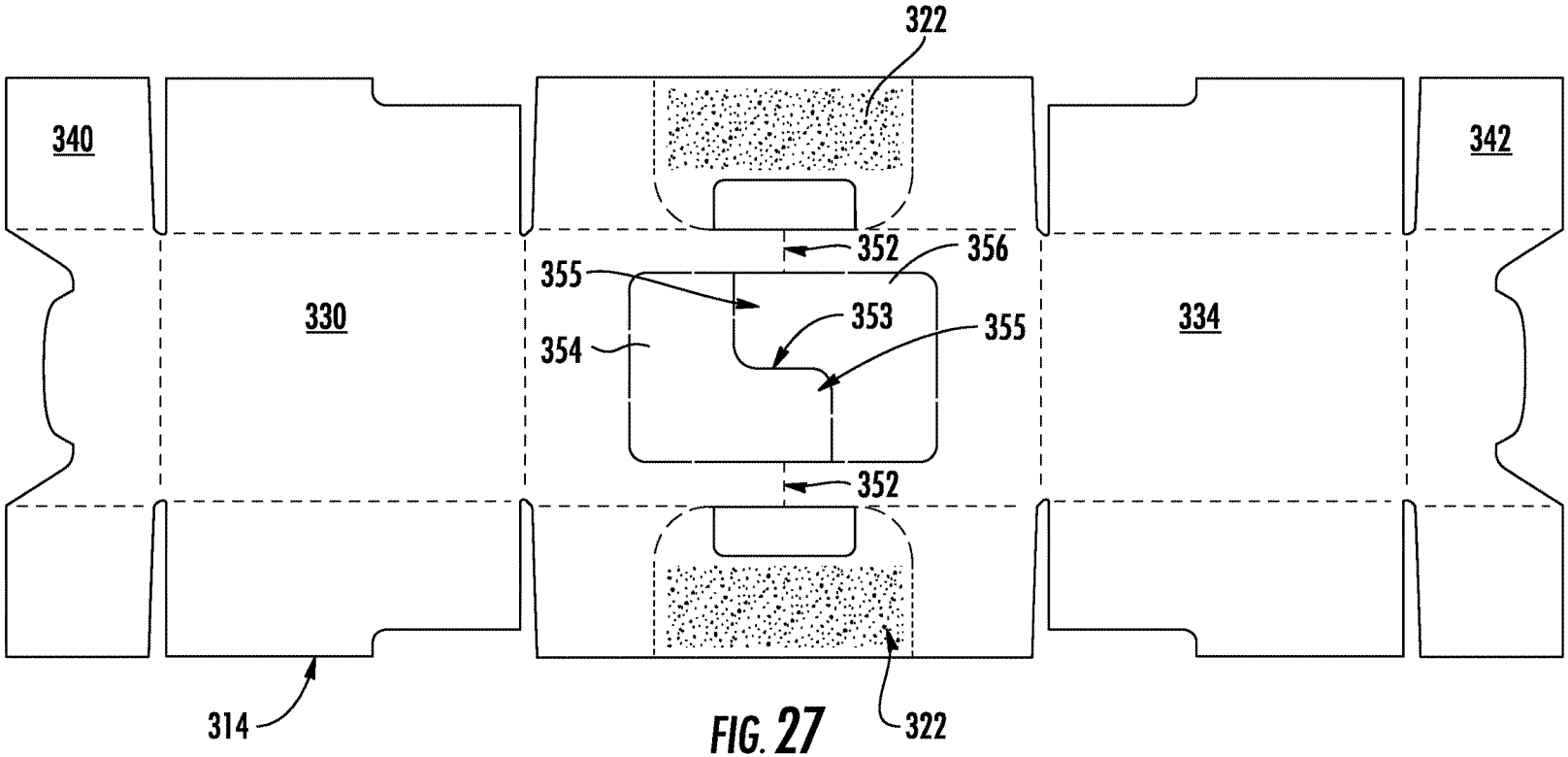
FIG. 27 is a schematic diagram of the first blank for the body of the convertible case for shipping and displaying food products, according to the exemplary embodiment of FIG. 21. The second blank for the hood may be the same or similar to that shown in FIG. 12.

Referring to FIGS. 25-26, it may be desirable to provide the capability to permit increased refrigerated airflow around the packages of food product in the display portions. According to the illustrated embodiment, vent panels 354, 356 are provided that may be selectively removed to permit enhanced air flow to, and around, the food packages. The vent panels 354, 356 are defined by perforated line 353 that is readily identifiable by stock personnel and may be readily removed using the upwardly extending legs 355 that form gripping tabs. The perforated lines defining the shape of the vent panels are intended to permit removal of a sufficient amount of the display portion walls, while still maintaining the structural integrity of the display portion for holding and displaying the packages. As shown in FIG. 26, removal of each vent portion 354, 356 reduces obstruction to air flow around the back of the display portion 302, 304, but retains a corner portion (e.g. post, etc.) on each side to retain structural integrity of the display portion and provide a rear product support surface for the packages. While the vent panels 354, 356 are shown on the back wall of each display portions, vent panel(s) may also be provided on the side walls according to alternative embodiments.

As previously described, the first display portion 302 and the second display portion 304 retain the logo area that may be sized, shaped and printed (or otherwise provided with) graphics or other indicia identifying the product and/or manufacturer for enhancing the display. The ability to separate a single case into two separate, vented, display portions permits the display portions to be arranged in a side-by-side manner or a front-to-back manner, as desired for stocking and merchandising purposes.

Figure 21:
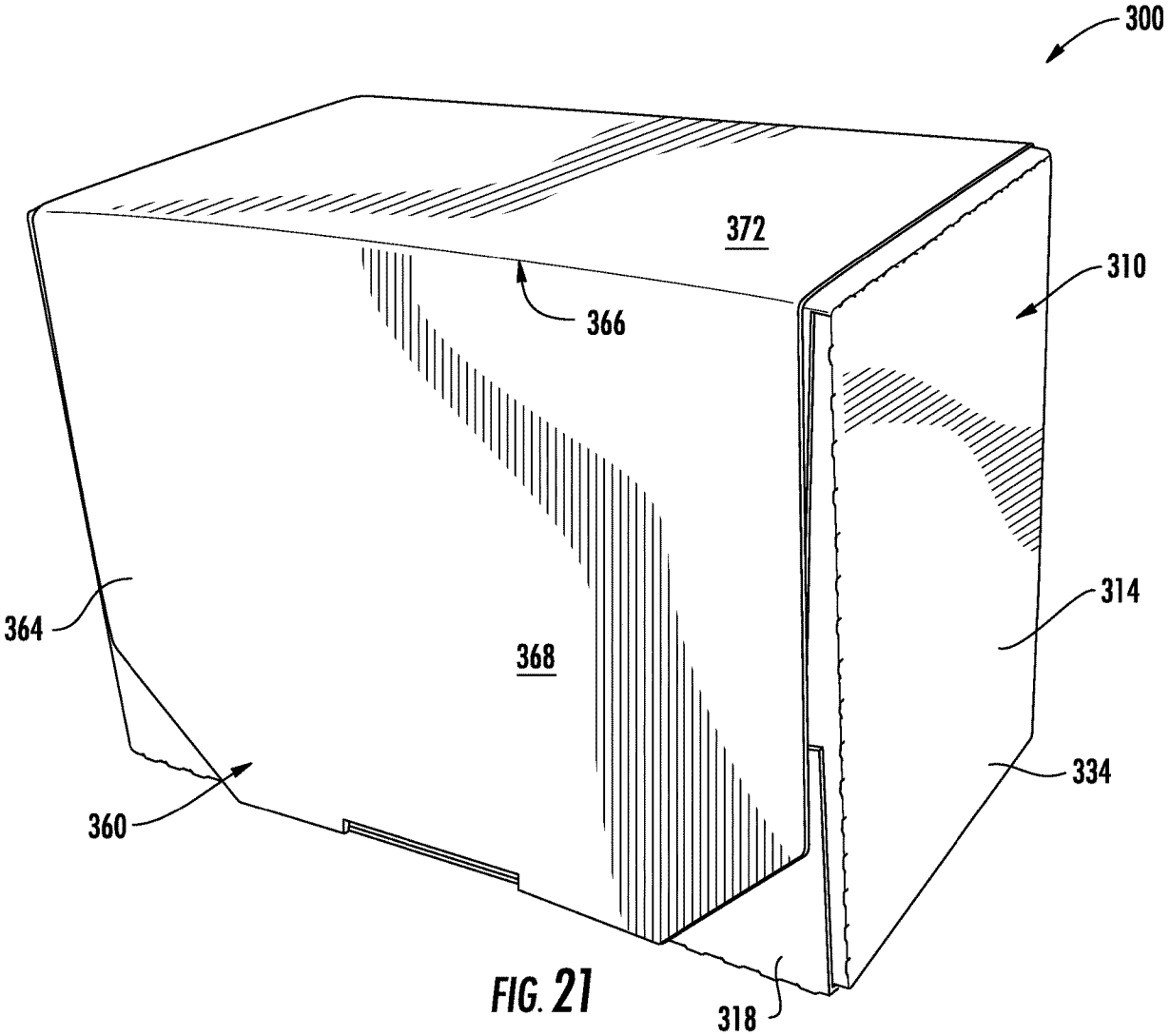
FIG. 21 is a pictorial image of a perspective view of a convertible case for shipping and displaying food products with the hood attached to the body in the shipping configuration, according to another exemplary embodiment.

Specific details and dimensions of a first blank 314 for the body 310 of the case 300 according to the embodiment of FIG. 21 are shown by way of example in FIG. 2. Similarly, specific details and dimensions of a second blank 364 for the hood of the case according to the embodiment of FIG. 21 may be the same or similar to those shown by way of example in FIG. 12.

It will be appreciated that the embodiments disclosed herein provide significant improvements to cases for shipping and displaying products, for example, food products. In some embodiments, different colors are used for different portions of the convertible case. For example, in one embodiment, the cover of the convertible case may be colored differently (e.g., brown) than the body of the convertible case. Different colors may indicate portions that are to be manipulated or removed from the convertible case, for example, to convert the case from a first configuration for shipping to a second configuration for displaying a product. For example, the cover, vents, tabs, etc. may be colored brown to indicate that these pieces are to be removed as part of the conversion process or for purposes of venting the product to, for example, provide air circulation to adequately cool the product contained therein. It will be further appreciated that the cover or hood portion of the case may be configured to cover or otherwise protect portions of the body of the case, such as logo panel areas. It will be further appreciated that, in some embodiments, the convertible case will include removable panels to increase the visibility of the product as displayed or to improve cooling. It will be further appreciated that, in some embodiments, the convertible case is configured such that the case does not need to be flipped or turned while converting the case from the shipping configuration to the display configuration. In some embodiments, the convertible case is configured such that food products stored within the case separate equally between two display portions during conversion of the case from the shipping configuration to the display configuration. It will be further appreciated that the convertible case may include perforations that are configured to tear easily or cleanly (e.g., short perforation, etc.) or otherwise tear as intended to prevent rough edges that detract from a consumer's perception of quality.

The construction and arrangement of the elements of the convertible case with deployable ventilation panels for shipping and displaying food products as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. The elements and assemblies may be constructed from any of a wide variety of materials that provide sufficient strength or durability, in any of a wide variety of colors, textures, and combinations. Additionally, in the subject description, the word "exemplary" is used to mean serving as an example, instance, or illustration. Any embodiment or design described herein as "exemplary" is not necessarily to be construed as preferred or advantageous over other embodiments or designs. Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A convertible case for shipping and displaying a food product, the convertible case comprising:

a body comprising:

a front portion and a back portion each having a partially open region and a removable portion, wherein each removable portion includes a fastening area;

a left side;

a right side;

a top portion having a left panel that includes a first logo area and a right panel that includes a second logo area, the first and second logo areas defining a partially open region; and a bottom portion having a removable bridge panel defined by two substantially parallel perforated lines, wherein a first removable vent panel is composed adjacent to a left side of the bridge panel and a second removable vent panel is composed adjacent to a right side of the bridge panel, and wherein each removable vent panel includes a push-in tab or a vent configured to increase airflow within the case for cooling the food product; and an inverted U-shaped cover comprising a top panel defined by two parallel hinge lines, a front panel, and a back panel, the front panel and the back panel each having a push-in tab;

wherein the cover is configured to fit over and attach to the body to provide a first configuration for shipping the food product.

2. The convertible case of claim 1, wherein the front panel of the cover is configured to attach to the fastening area on the removable portion of the front portion of the body and to cover the front partially open region, wherein the back panel of the hood is configured to attach to the fastening area on the removable portion of the back portion of the body and to cover the back partially open region, and wherein the top panel of the cover covers the top partially open region of the top of the body.

3. The convertible case of claim 2, wherein the front panel of the cover and the back panel of the cover are configured to attach to the fastening areas using glue.

4. The convertible case of claim 2, wherein the case is configured to be manually converted into a second configuration for displaying the food product.

5. The convertible case of claim 4, wherein the second configuration comprises two display portions formed by pulling the cover free from the body along with the removable portions of the front portion and the back portion, outwardly tilting the left side and the right side about the bridge panel, and removing the bridge panel.

6. The convertible case of claim 4, wherein each display portion is configured to display approximately one half of the food product.

7. The convertible case of claim 1, wherein the body is formed from a first blank comprised of a first material and the cover is formed from a second blank comprised of a second material.

8. The convertible case of claim 1, wherein the body and the cover are comprised of cardboard.

9. The convertible case of claim 1, wherein each vent panel is defined by perforated lines in the general shape of a rectangle.

10. A convertible case for shipping and displaying a food product, the convertible case comprising:

a body comprising:

a front portion and a back portion each having a partially open region and a removable portion, wherein each removable portion includes a fastening area;

a left side;

a right side;

a top portion having a left panel that includes a first logo area and a right panel that includes a second logo area, the first and second logo areas defining a partially open region; and a bottom portion having a perforated line disposed substantially across the center of the bottom portion, wherein a first removable vent panel is composed adjacent to a left side of the perforated line and a second removable vent panel is composed adjacent to a right side of the perforated line, and wherein each removable vent panel includes a push-in tab or a vent configured to increase airflow within the case for cooling the food product; and an inverted U-shaped cover comprising a top panel defined by two parallel hinge lines, a front panel, and a back panel, the front panel and the back panel each having a push-in tab;

wherein the cover is configured to fit over and attach to the body to provide a first configuration for shipping the food product.

11. The convertible case of claim 10, wherein each vent panel is defined by perforated lines that extend substantially across the full width of the bottom portion and then taper along a sloped line to define a lower portion smaller than the full width of the bottom portion and having a push-in tab, and wherein upon removal of the vent panels, the remaining bottom portion provides product support surfaces for a second configuration of the case for displaying the food product.

12. The convertible case of claim 10, wherein the front panel and back panel are configured to attach to the fastening areas using glue.

13. The convertible case of claim 10, wherein the case is configured to be manually converted into a second configuration for displaying the food product.

14. The convertible case of claim 13, wherein the second configuration comprises two display portions formed by pulling the cover free from the body along with the removable portions of the front portion and the back portion, outwardly tilting the left side and the right side about the perforated line on the bottom of the body, and separating the perforated line on the bottom of the body.

15. The convertible case of claim 14, wherein each removable vent panel is selectively removable to permit increased airflow within each display portion for cooling the food product.

16. A convertible case for shipping and displaying packages of a food product, the case comprising:

a body formed from a first blank, the body comprising:

a front portion and a back portion each having a partially open region and a removable portion, wherein each removable portion includes a fastening area;

a left side;

a right side;

a top portion having a left panel that includes a first logo area and a right panel that includes a second logo area, the first and second logo areas defining a partially open region; and a bottom portion having a plurality of perforated lines, including two outer perforated line segments disposed substantially across the center of the bottom portion and an S-shaped perforated line adjoining the two outer perforated line segments, wherein a first removable vent panel is composed adjacent to a left side of the plurality of perforated lines and a second removable vent panel is composed adjacent to a right side of the plurality of perforated lines, wherein each removable vent panel is defined by the plurality of perforated lines to form an L-shape, and wherein each removable vent panel includes a push-in tab or a vent configured to increase airflow within the case for cooling the packages of the food product; and an inverted U-shaped cover formed from a second blank by folding the second blank about two parallel hinge lines, the cover comprising a top panel, a front panel, and a back panel, the front panel and the back panel each having a push-in tab;

wherein the cover is configured to fit over and attach to the body to provide a first configuration for shipping the packages of the food product.

17. The convertible case of claim 16, wherein the case is configured to be manually converted into a second configuration for displaying the packages of the food product.

18. The convertible case of claim 17, wherein the second configuration comprises two display portions formed by pulling the cover free from the body along with the removable portions of the front portion and the back portion, outwardly tilting the left side and the right side about the plurality of perforated lines on the bottom of the body, and separating the plurality of perforated lines on the bottom of the body.

19. The convertible case of claim 17, wherein upon removal of the vent panels, the remaining bottom portion provides product support surfaces for the second configuration of the case for displaying the packages of the food product.

20. The convertible case of claim 16, wherein the front panel and back panel are configured to attach to the fastening areas using a temporary fastening material.

* * * * *